US010303086B2

(12) United States Patent
Jimba et al.

(10) Patent No.: US 10,303,086 B2
(45) Date of Patent: May 28, 2019

(54) DEVELOPER SUPPLY CONTAINER AND DEVELOPER SUPPLYING APPARATUS

(71) Applicant: CANON KABUSHIKI KAISHA, Tokyo (JP)

(72) Inventors: Manabu Jimba, Toride (JP); Ayatomo Okino, Moriya (JP); Takao Nakajima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/855,514

(22) Filed: Sep. 16, 2015

(65) Prior Publication Data

US 2016/0004186 A1 Jan. 7, 2016

Related U.S. Application Data

(63) Continuation of application No. PCT/JP2013/060414, filed on Mar. 29, 2013.

(30) Foreign Application Priority Data

Mar. 19, 2013 (JP) ..... 2013-056447

(51) Int. Cl.
*G03G 15/08* (2006.01)

(52) U.S. Cl.
CPC ..... *G03G 15/0867* (2013.01); *G03G 15/0872* (2013.01); *G03G 2215/0678* (2013.01)

(58) Field of Classification Search
CPC ..... G03G 15/086; G03G 15/0862
See application file for complete search history.

(56) References Cited

U.S. PATENT DOCUMENTS 7,050,728 B2 5/2006 Minagawa et al.
8,000,614 B2 8/2011 Okino et al.
(Continued)

FOREIGN PATENT DOCUMENTS

CN 102378941 A 3/2012
CN 102597887 A 7/2012
(Continued)

OTHER PUBLICATIONS

Written Opinion of the International Searching Authority and International Search Report in International Patent Application No. PCT/JP2013/060414.
(Continued)

*Primary Examiner* — Victor Verbitsky
(74) *Attorney, Agent, or Firm* — Venable LLP

(57) ABSTRACT

A developer supply container includes a developer accommodating portion 2*a* for accommodating toner, a developer supply opening 5*b* for discharging the toner accommodated in the developer accommodating portion 2*a* from the developer supply container 1, a feeding portion 2*b* for feeding the toner in the developer accommodating portion 2*a* toward the developer supply opening 5*b*, a rotatable drive receiving portion 7*a* for receiving a rotational force for rotating the feeding portion 2*b*, and a holding projection 4*h* held by a holding mechanism 304 provided in the developer supply container 1 to determine a position of the developer supply container 1, wherein the developer supply opening 5*b* is disposed between the drive receiving portion 7*a* and the holding projection 4*h*. By this, a stability of connection between the discharge opening of the developer supply container and the receiving port of the image forming apparatus side is improved.

3 Claims, 17 Drawing Sheets

(56) References Cited

U.S. PATENT DOCUMENTS

| | | | | |
|---|---|---|---|---|
| 2008/0124133 | A1* | 5/2008 | Yoshizawa | G03G 15/0898 399/262 |
| 2008/0240771 | A1* | 10/2008 | Kurita | G03G 15/0872 399/106 |
| 2010/0209141 | A1 | 8/2010 | Ikado | |
| 2012/0014713 | A1* | 1/2012 | Murakami | G03G 15/0865 399/119 |
| 2012/0163877 | A1 | 6/2012 | Kikuchi et al. | |
| 2012/0195645 | A1* | 8/2012 | Takami | G03G 15/0886 399/262 |
| 2012/0219330 | A1 | 8/2012 | Ikado | |
| 2014/0016967 | A1 | 1/2014 | Murakami et al. | |
| 2014/0153974 | A1 | 6/2014 | Jimba et al. | |
| 2014/0233986 | A1 | 8/2014 | Murakami et al. | |
| 2015/0378278 | A1 | 12/2015 | Kamura et al. | |
| 2016/0004185 | A1 | 1/2016 | Enokuchi et al. | |
| 2016/0004187 | A1 | 1/2016 | Yomoda et al. | |
| 2016/0004188 | A1 | 1/2016 | Kamura et al. | |

FOREIGN PATENT DOCUMENTS

| | | | |
|---|---|---|---|
| JP | 2006-047354 | A | 2/2006 |
| JP | 2010-191016 | A | 9/2010 |
| JP | 2010-256893 | A | 11/2010 |
| JP | 2010-262236 | A | 11/2010 |
| JP | 2012-113329 | A | 6/2012 |
| JP | 2013-015826 | A | 1/2013 |

OTHER PUBLICATIONS

Dec. 20, 2018 Office Action in Chinese Patent Application No. 201380075526.X (with English translation).

* cited by examiner (a)

(b)

(a)

(b)

(a)

(b)

(a)

(b)

(a)

(b)

(a)

(b)

(a)

(b)

(a)

(b)

(c)

(a)

(b)

| | MOUNTING STABILITY | SUPPLY STABILITY | CONTAMINATION WITH DEVELOPER | DOWNSIZING |
|---|---|---|---|---|
| EMBODIMENT | ○ | ○ | ○ | ○ |
| COMP EX. 1 | ○ | × | × | × |
| COMP EX. 2 | × | × | × | ○ |

DEVELOPER SUPPLY CONTAINER AND DEVELOPER SUPPLYING APPARATUS

The present invention relates to a developer supply container and a developer supplying apparatus, which are usable with an image forming apparatus

BACKGROUND ART

Recently, the developer supply container used with the image forming apparatus is dominantly a stationary type, with which a developer is supplied by a main assembly of the image forming apparatus, as required.

When the developer in the stationary type becomes short, the user exchanges the developer supply container. A developer supply container with which a scattering developer amount inside the main assembly of the image forming apparatus is small is desired.

In a developer supply container disclosed in Japanese Laid-open Patent Application 2010-256893, a pressure difference is produced between the inner and outer sides of the developer supply container by a pressure generating means provided in the developer supply container and using the pressure difference, the developer is discharged through a small diameter discharge opening. By this, the developer can be supplied stably, and the developer scattering amount is small because the discharge opening has a small diameter.

SUMMARY OF THE INVENTION

Problem to be Solved by the Invention

With the developer supply container of Japanese Laid-open Patent Application 2010-256893, an improvement of a stability of connection between the discharge opening of the developer supply container and a developer receiving port of an image forming apparatus side is desired.

Accordingly, the present invention is intended to solve the problem, and it is a object of the present invention to provide a developer supply container with which the stability of the connection between the discharge opening of the developer supply container and the receiving port of the image forming apparatus side is improved.

Means for Solving the Problem

The present invention provides a developer supply container detachably mountable to a developer supplying apparatus, said developer supply container comprising a developer accommodating portion for accommodating a developer; a discharge opening for discharging the developer accommodated in said developer accommodating portion from developer supply container; a feeding portion for feeding the developer in said developer accommodating portion toward said discharge opening; a rotatable drive receiving portion for receiving a rotational force for rotating said feeding portion; and a holding portion held by a holding mechanism provided in said developer supply container to determine a position of said developer supply container relative to said developer supplying apparatus, wherein said discharge opening is disposed between said drive receiving portion and said holding portion with respect to a rotational axis direction.

Effect of the Invention

According to this structure, the stability of the connection between the discharge opening of the developer supply container and the receiving port of the image forming apparatus side is improved.

Figure 3:
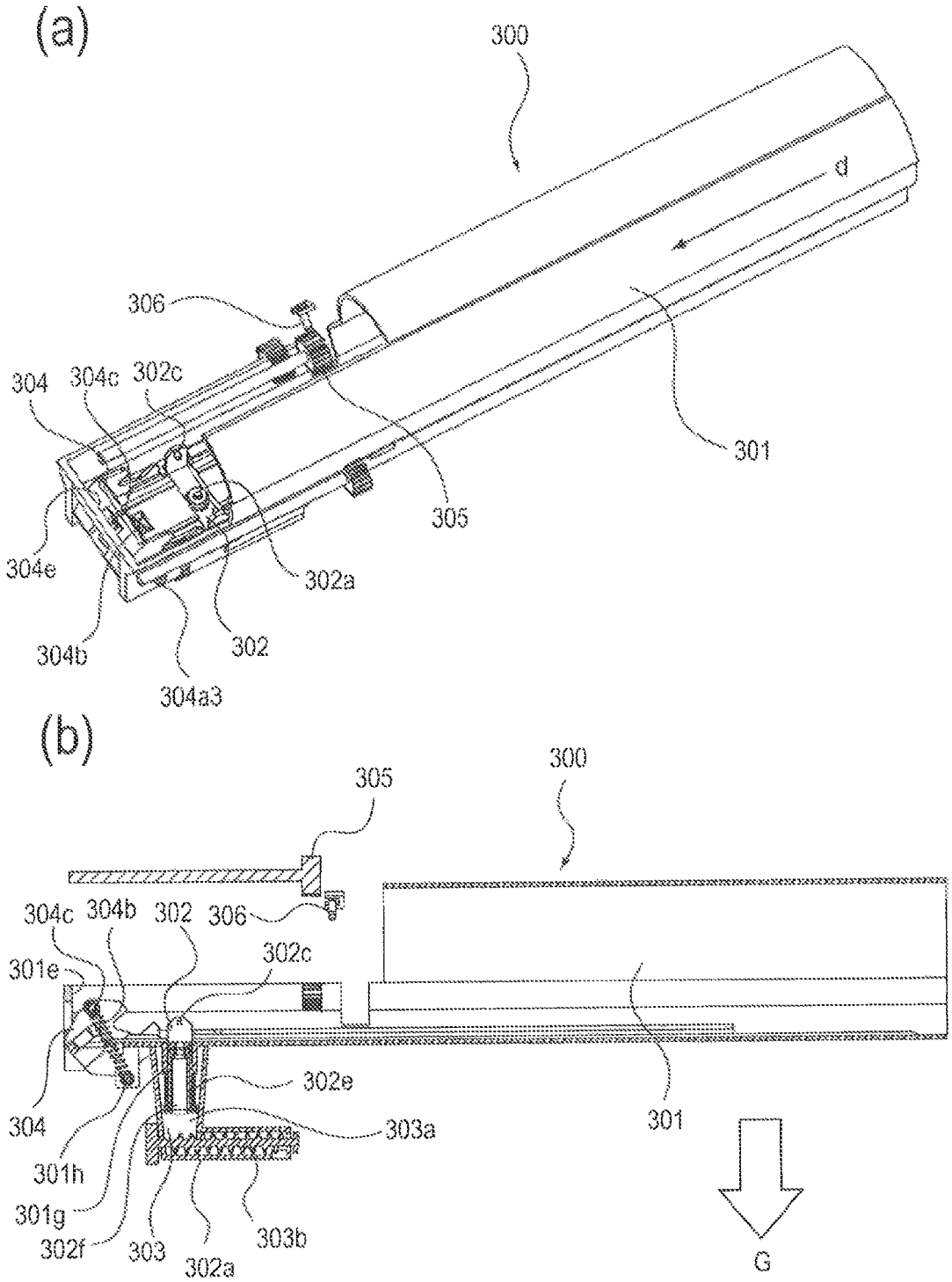

Part (a) of FIG. 3 is a schematic perspective view illustrating a structure of a developer receiving device, and (b) is a schematic sectional view illustrating a structure of the developer receiving device.

Figure 4:
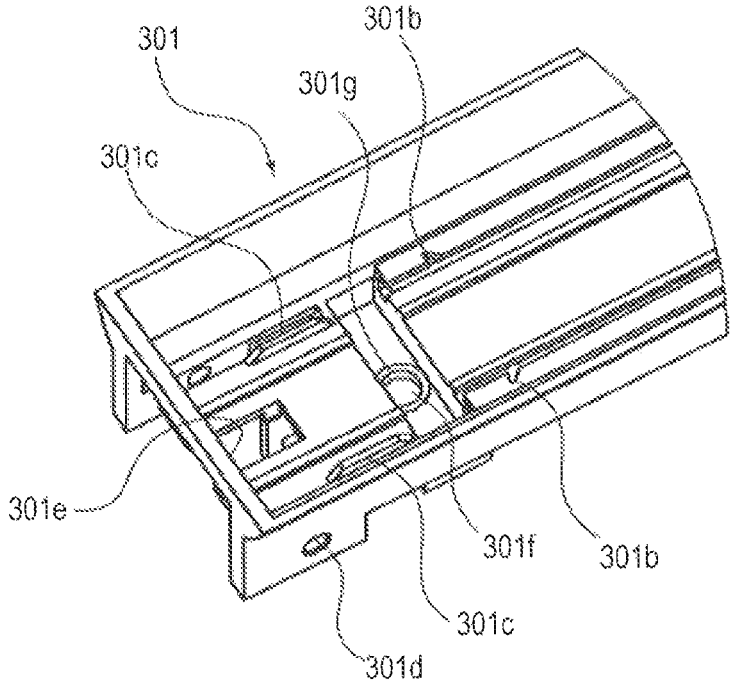
Figure 4:
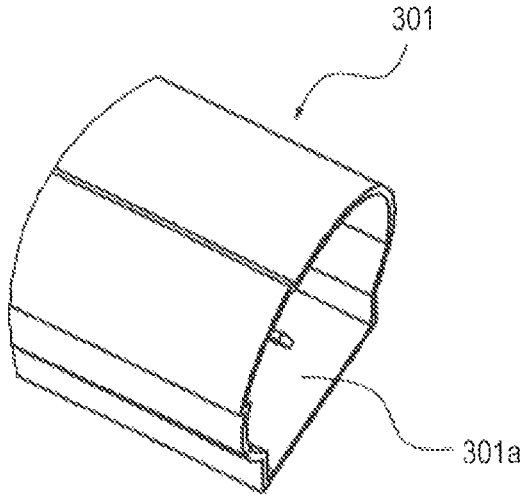

Parts (a) said (b) of FIG. 4 are schematic perspective views illustrating a structure of a housing.

Figure 5:
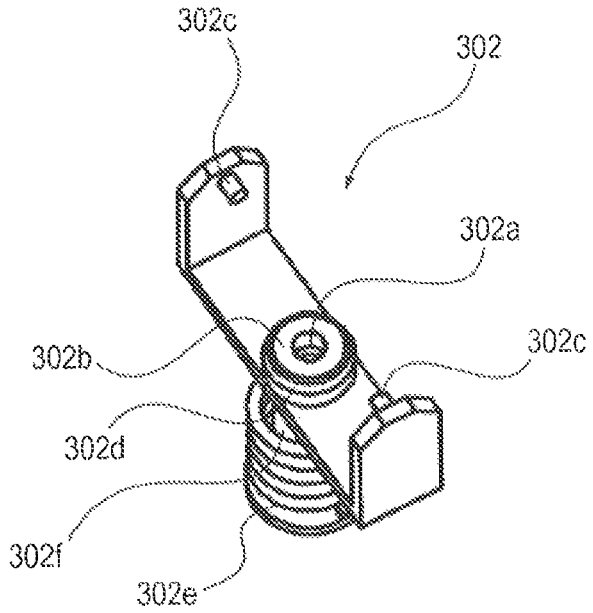
Figure 5:
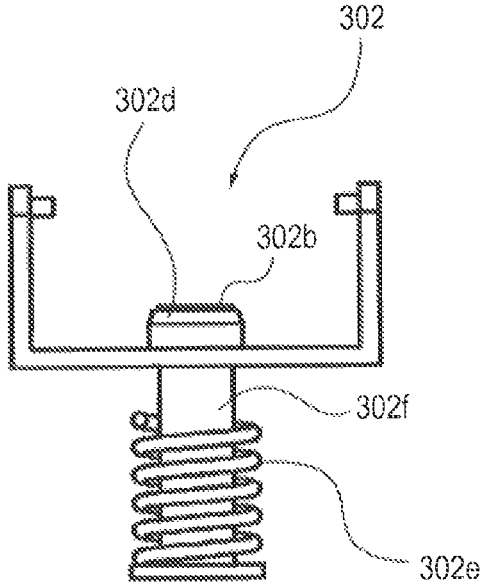

Part (a) of FIG. 5 is a schematic perspective view illustrating a structure of a developer receiving portion, and (b) is a substantial front view of the structure of the developer receiving portion.

Figure 6:
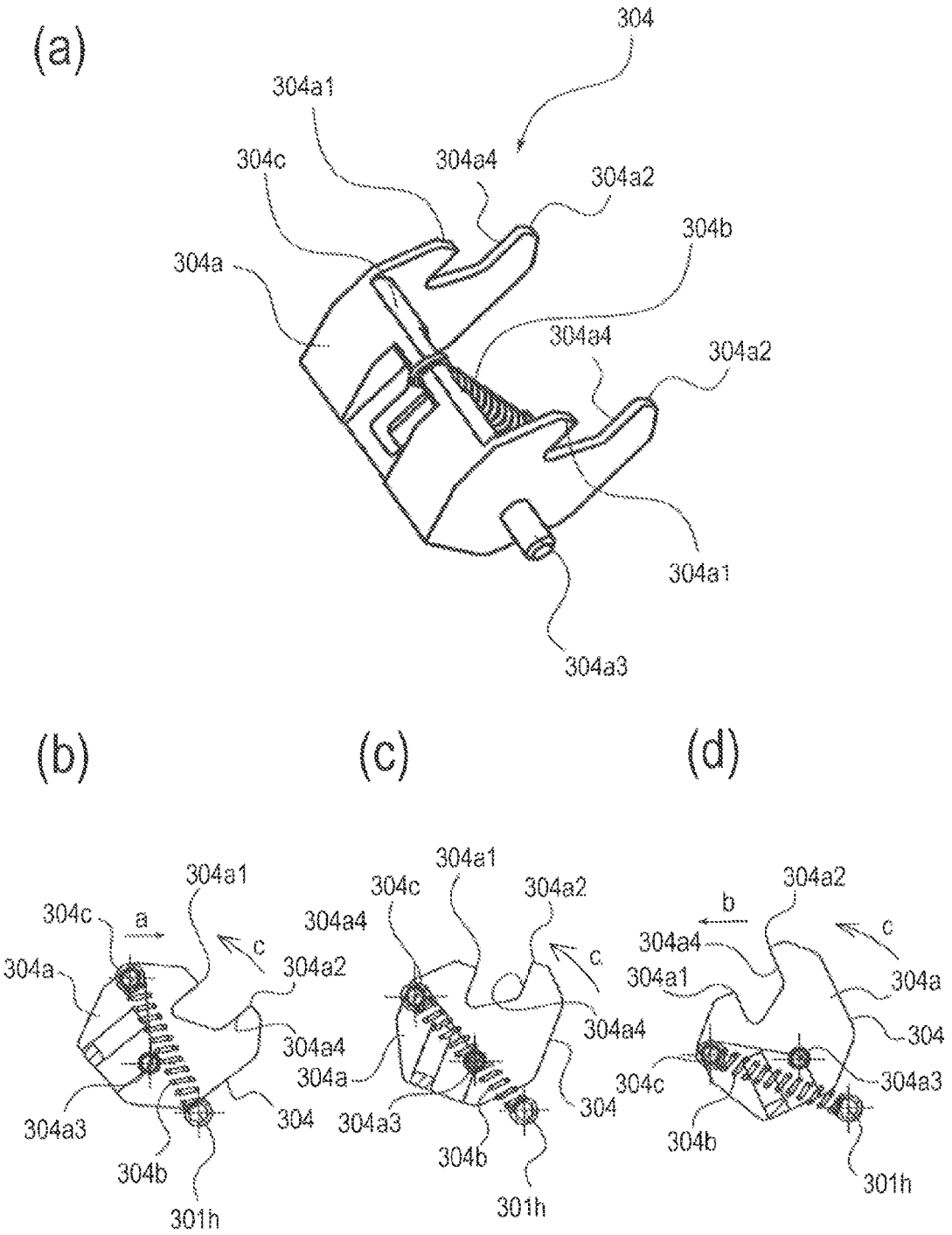

Part (a) of FIG. 6 is a schematic perspective view illustrating a structure of a holding mechanism, and (b)-(d) are schematic side views illustrating a rotation of the holding mechanism.

Figure 7:
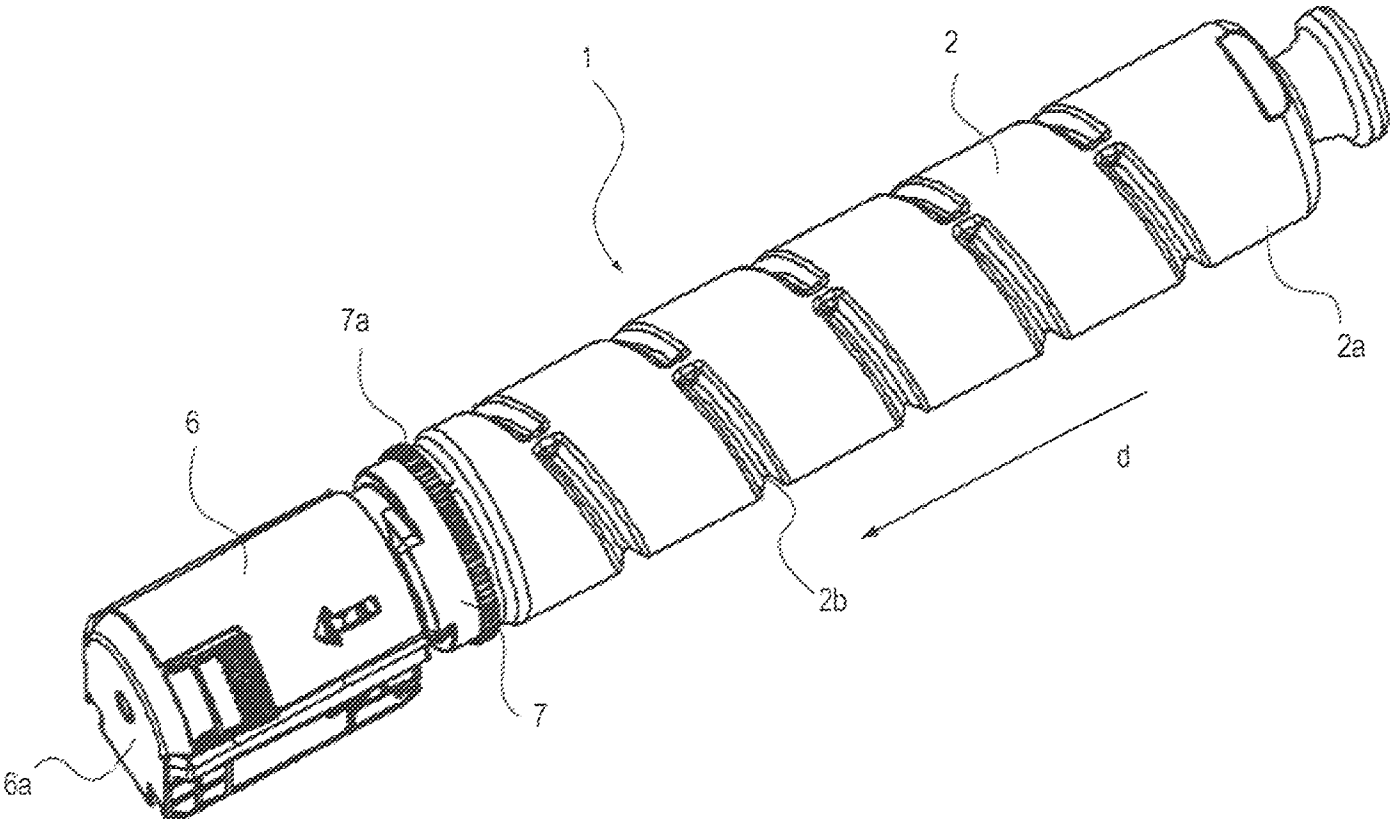

FIG. 7 is a schematic perspective view illustrating a structure of the developer supply container.

Figure 8:
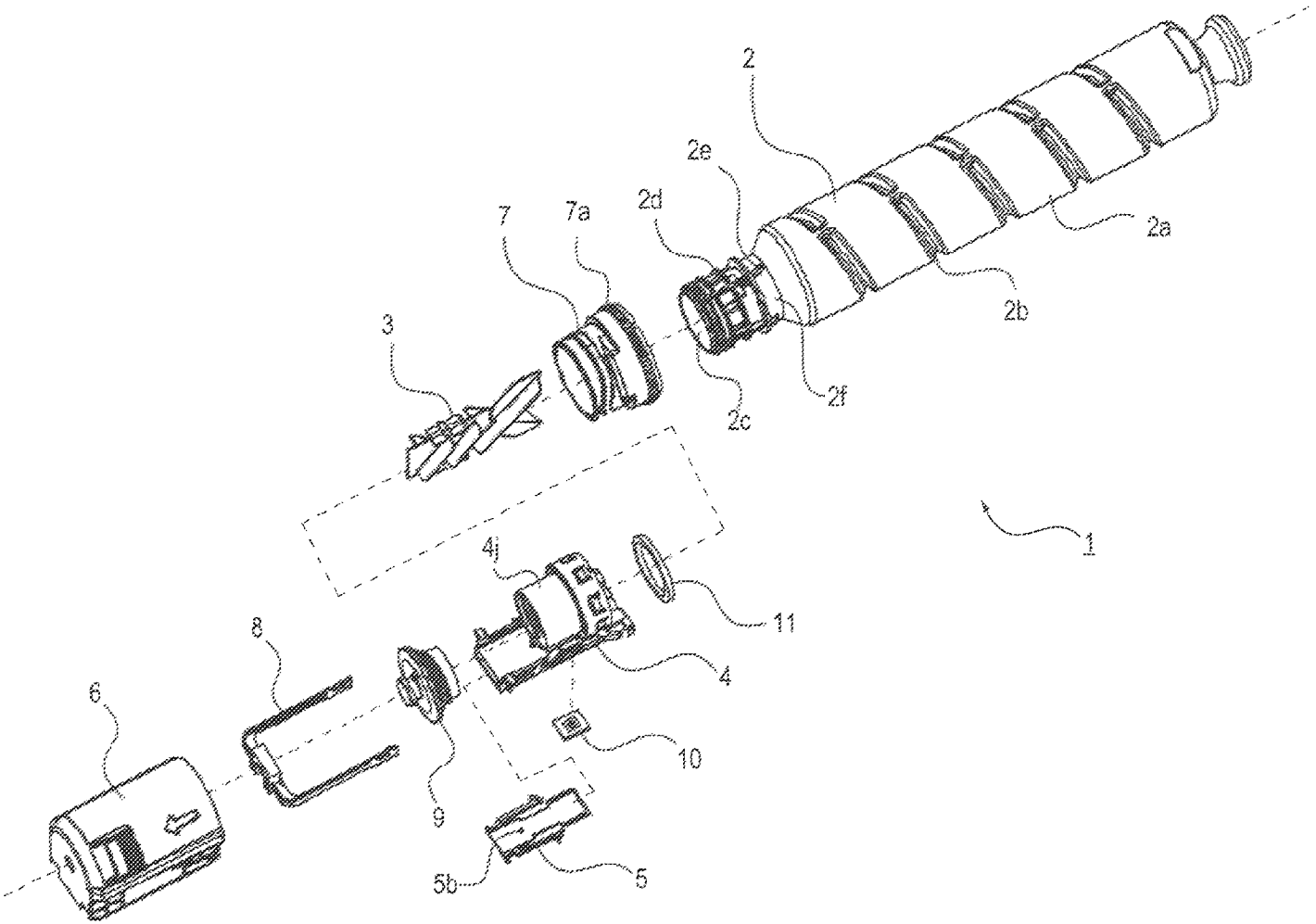

FIG. 8 is an exploded perspective view illustrating a structure of the developer supply container.

Figure 9:
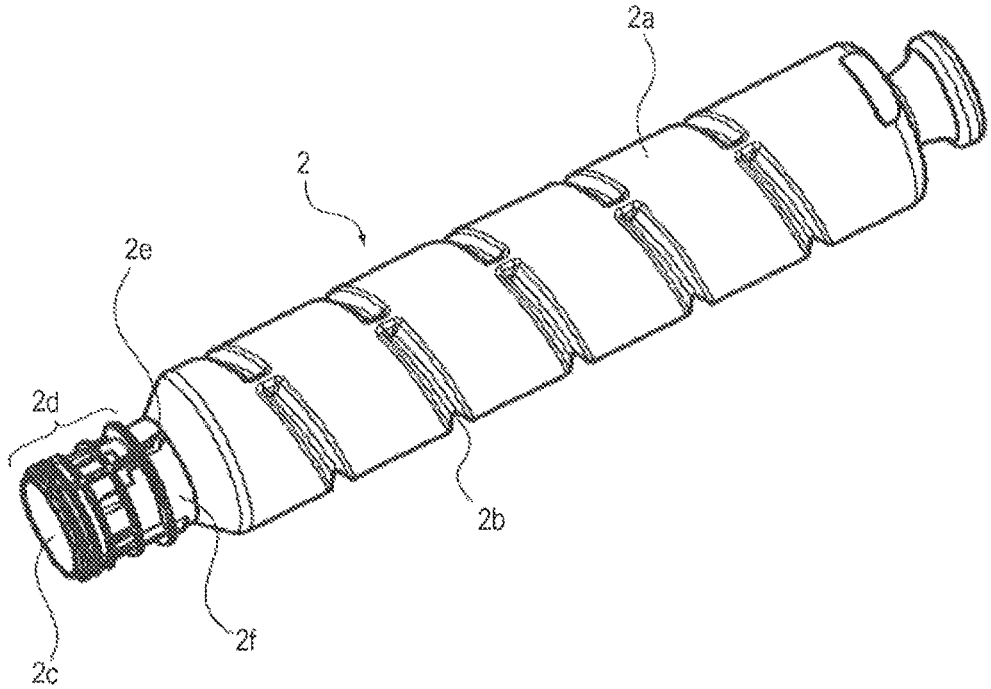
Figure 9:
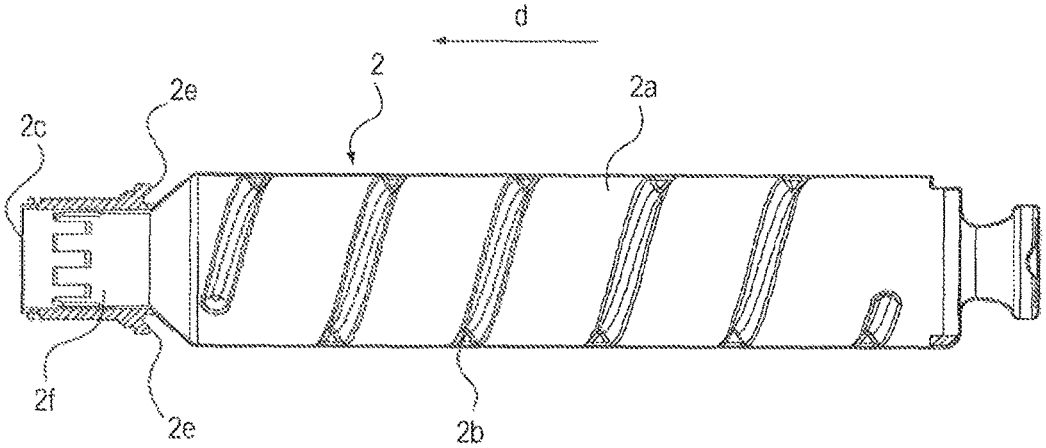

Part (a) of FIG. 9 is a schematic perspective view illustrating a structure of a developer accommodation member, and (b) is a substantial front view illustrating a structure of the developer accommodation member.

Figure 10:
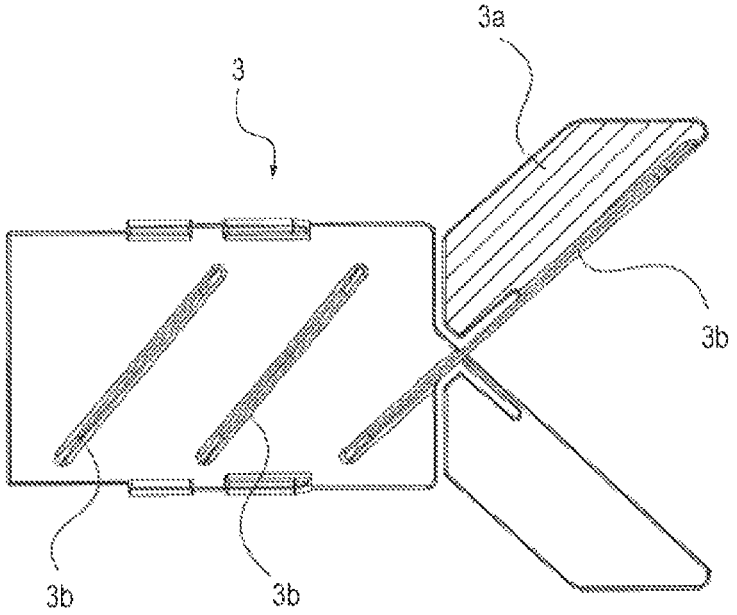
Figure 10:
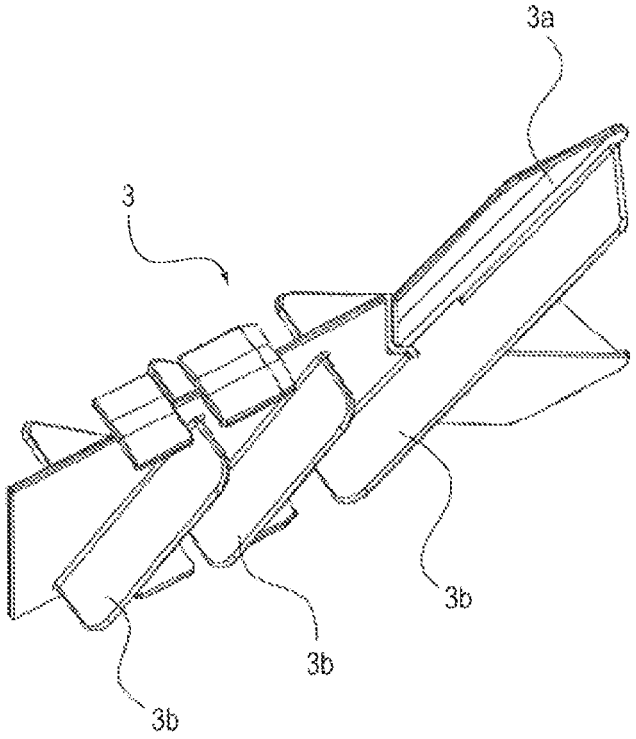

Part (a) of FIG. 10 is a schematic sectional view illustrating a structure of a feeding member, and (b) is a schematic perspective view illustrating a structure of the feeding member.

Figure 11:
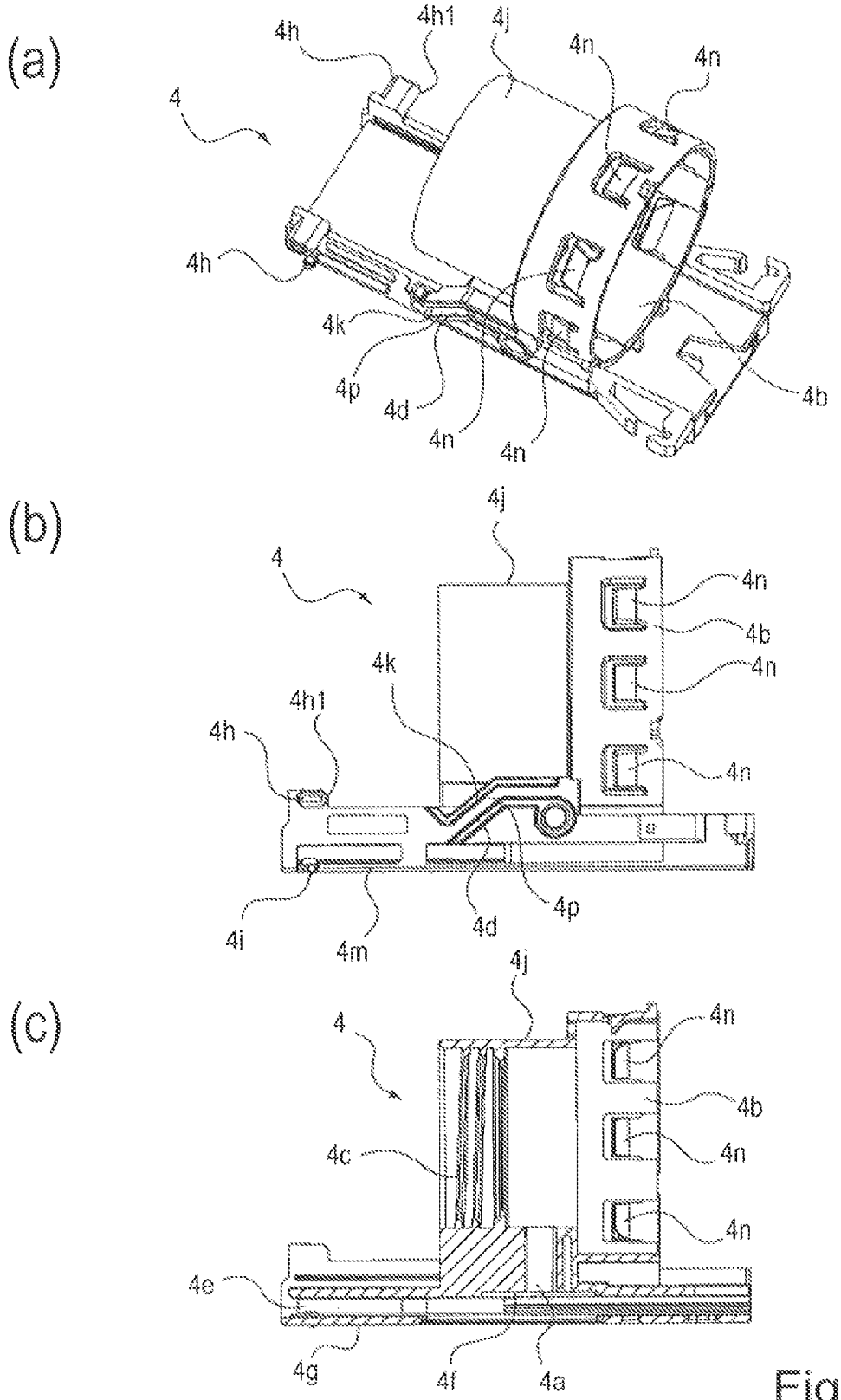

Part (a) of FIG. 11 is a schematic perspective view illustrating a structure of a holding mechanism, (b) is a schematic side view illustrating a structure of the holding mechanism, and (c) is a schematic sectional view illustrating a structure of the holding mechanism.

Figure 12:
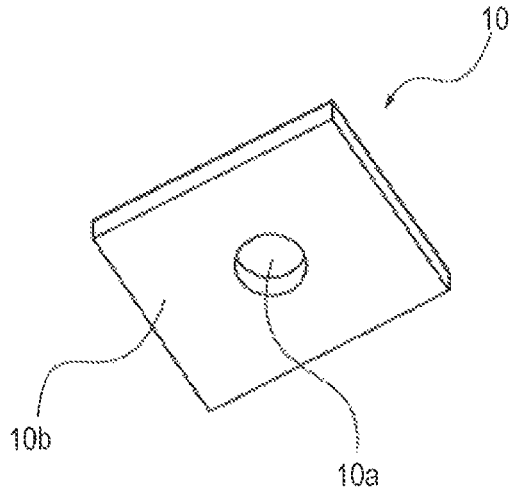
Figure 12:
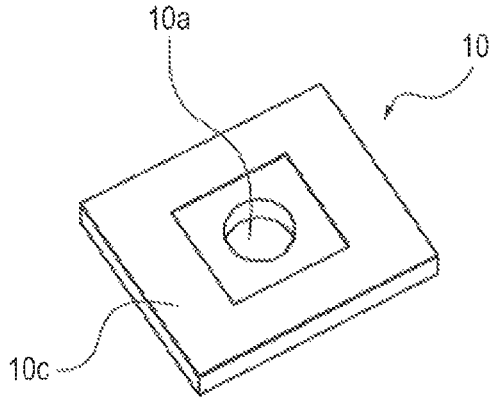

Part (a) of FIG. 12 is a schematic perspective view illustrating a structure of a seal surface side of an opening seal, and (b) is a schematic perspective view illustrating a structure of a fixed surface side of the opening seal.

Figure 13:
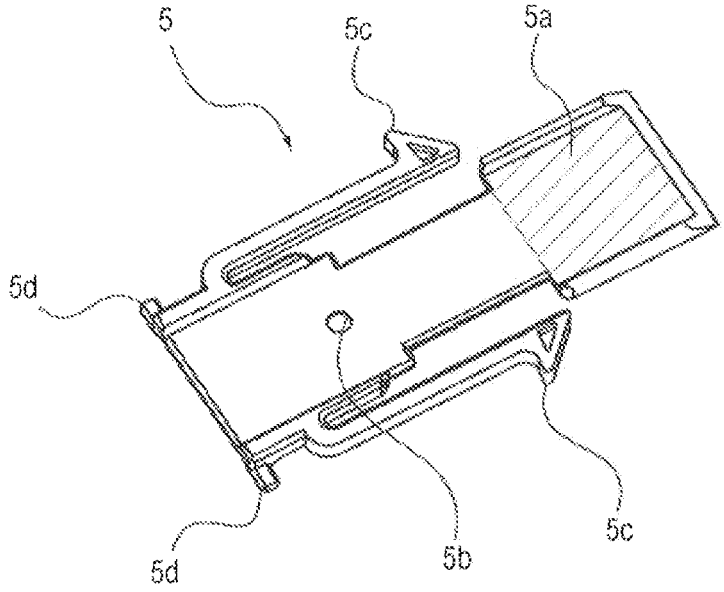
Figure 13:
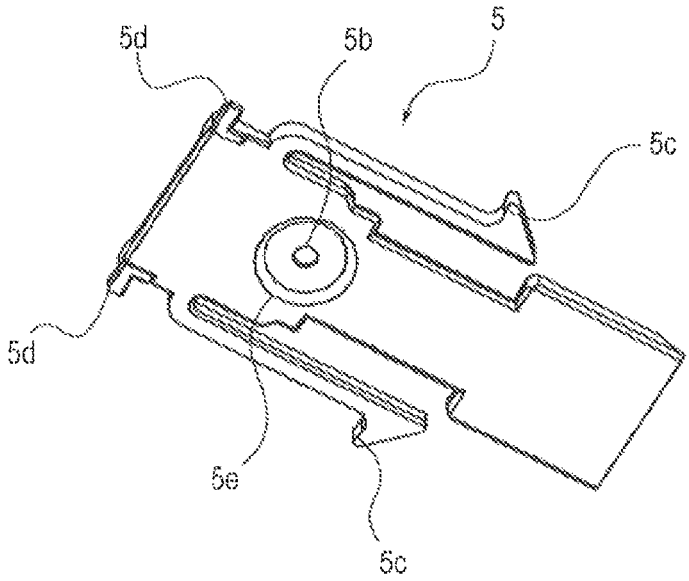

Part (a) of FIG. 13 is a schematic perspective view illustrating a structure of a sealing surface side of a bottle shutter, and (b) is a schematic perspective view illustrating a structure of a guiding portion side.

Figure 14:
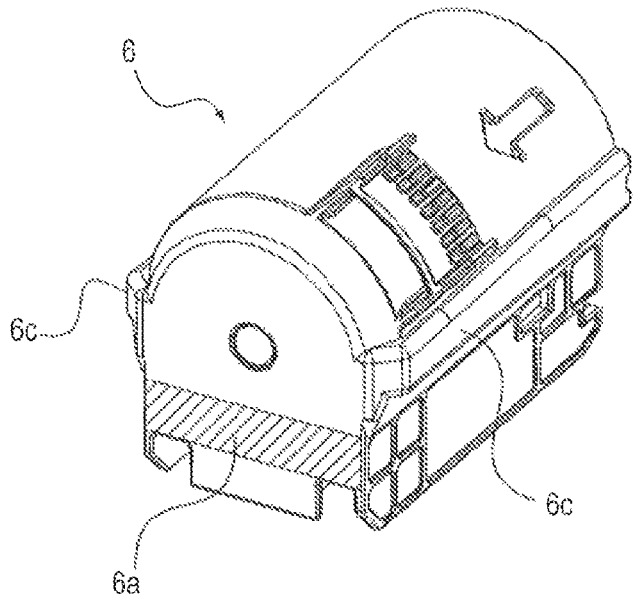
Figure 14:
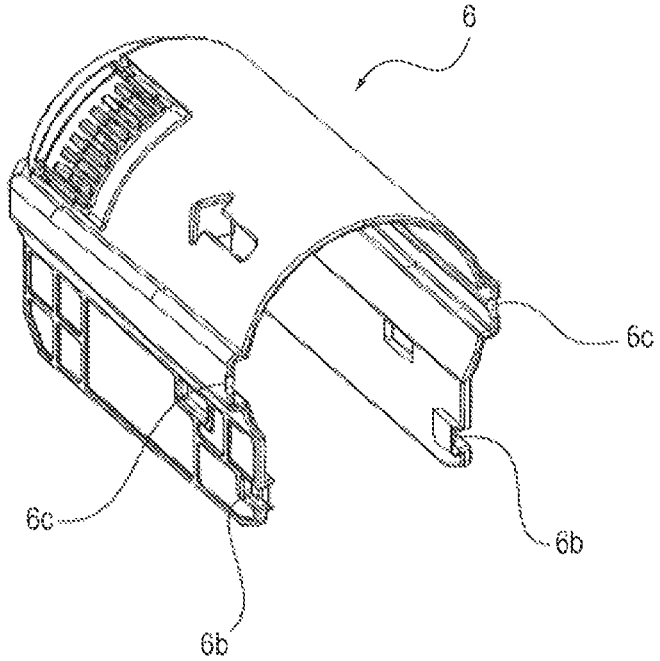

Part (a) of FIG. 14 is a schematic perspective view illustrating a structure of a contact surface side of a protecting member, and (b) is a schematic perspective view illustrating a structure of an engaging portion side of the protecting member.

Figure 15:
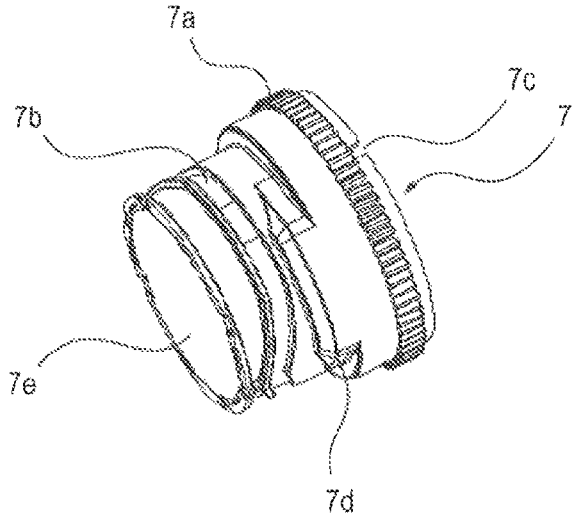
Figure 15:
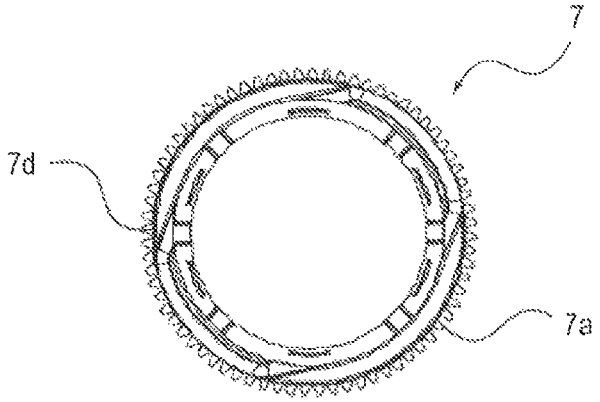
Figure 15:
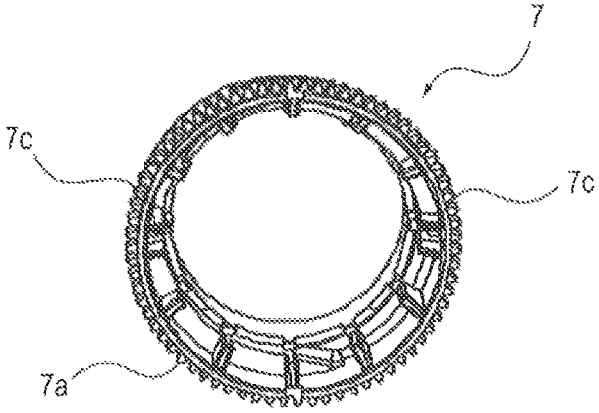

Part (a) of FIG. 15 is a schematic perspective view illustrating a structure of a power conversion members, (b) is substantial front view illustrating a structure of a cam groove side of the power conversion member, and (c) is a substantial rear view illustrating a structure of an engaging portion side of the power conversion member.

Figure 16:
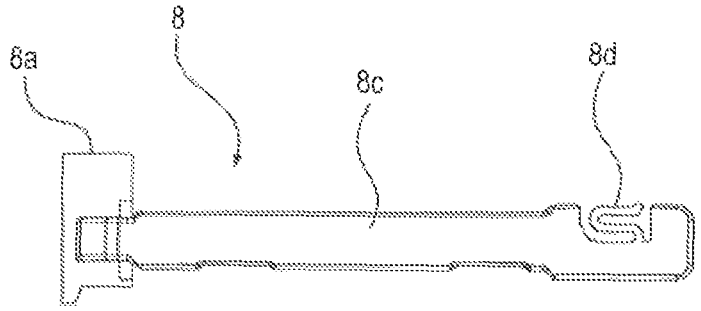
Figure 16:
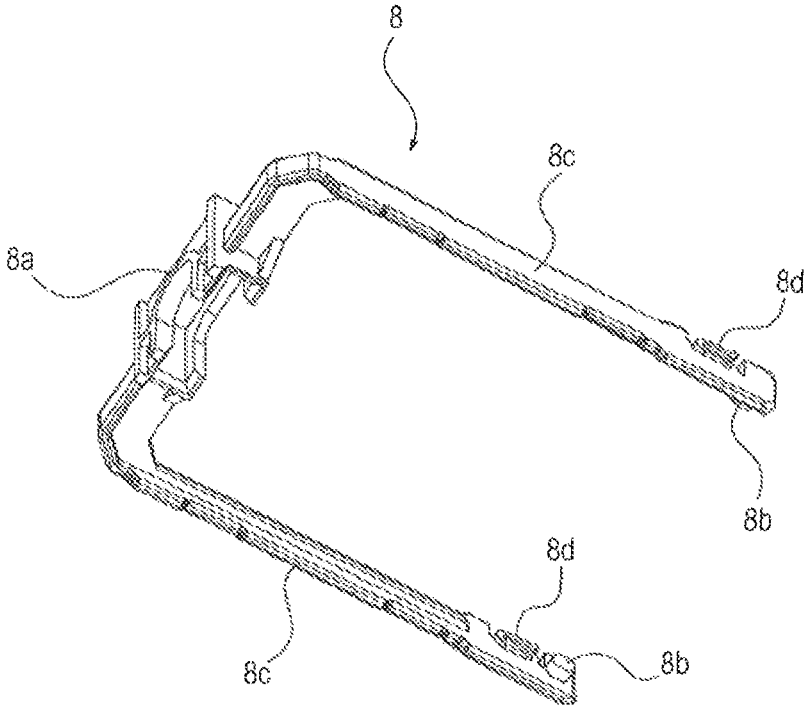

Part (a) of FIG. 16 is a schematic side view illustrating a structure of a reciprocating member, and (b) is a schematic perspective view illustrating a structure of the reciprocating member.

Figures 17, 18:
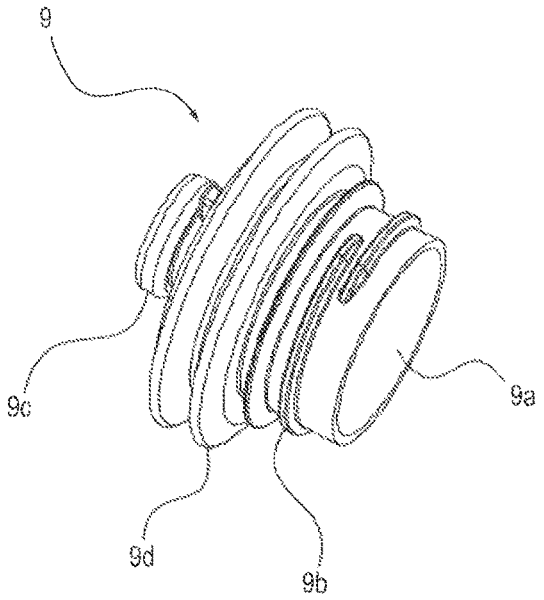

FIG. 17 is a schematic perspective view illustrating a structure of a volume change means.

FIG. 18 illustrates a result of property comparison and the developer supply container of this embodiment and a developer supply containers according to comparison examples 1 and 2.

DESCRIPTION OF THE EMBODIMENTS

Referring to the accompanying drawings, a developer supply container according to one embodiment of the present invention will be described specifically. In the following description, various structures of the developer supply container 1 may be replaced with another unknown structure having similar functions within the concept of the present invention, unless otherwise specified. That is, the present invention is not restricted to the structure of the developer supply container 1 of the embodiments which will be described hereinafter.

First, the description will be made as to the structure of an image forming apparatus 100 provided with the developer supply container 1 according to the present invention, and then, the description will be made as to the structure of the developer supplying system including a developer receiving device 300 and the developer supply container 1 used with the image forming apparatus 100.

<Image Forming Apparatus>

Figure 1:
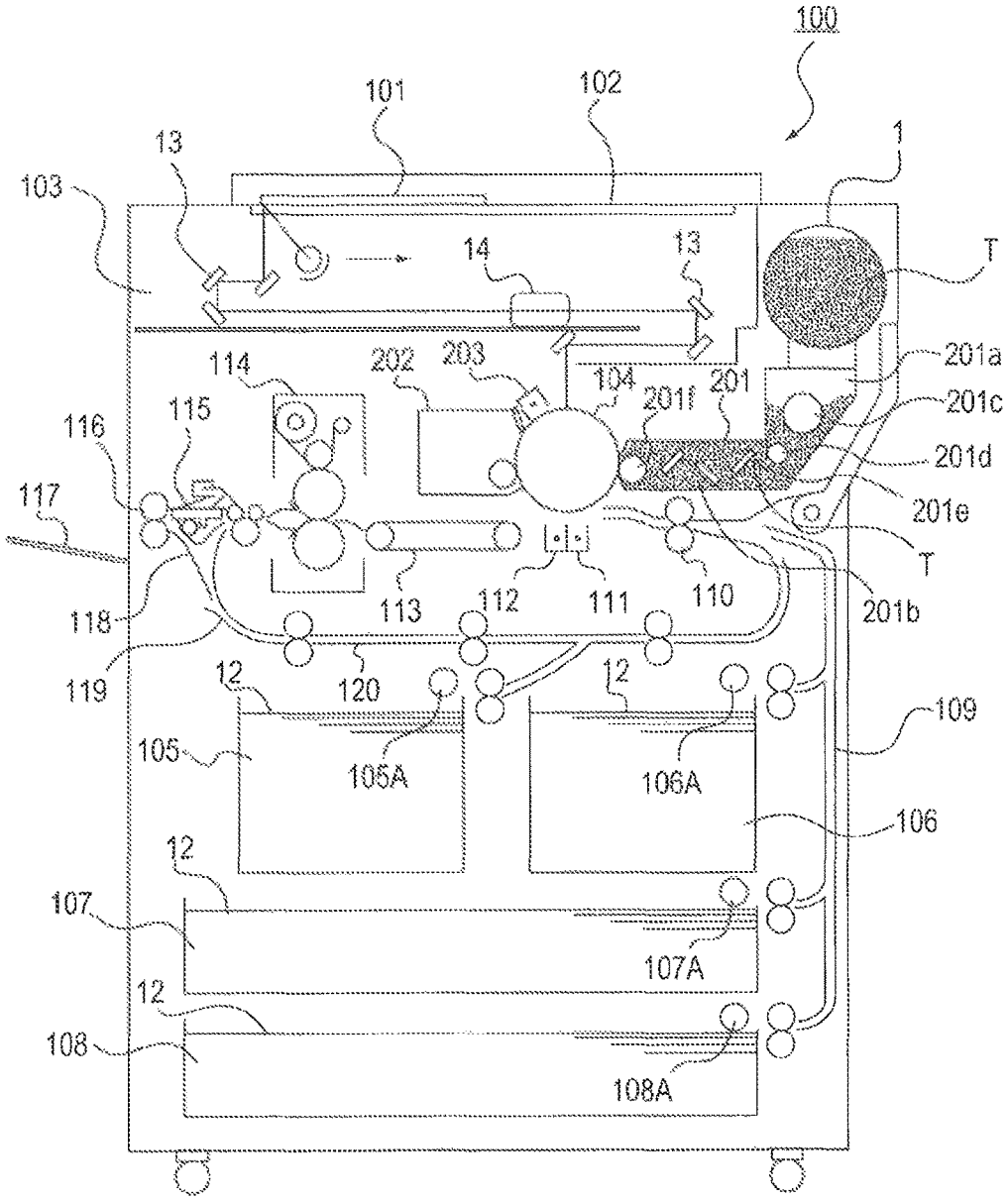
FIG. 1 is a schematic sectional view illustrating a structure of an image forming apparatus provided with a developer supply container according to the present invention.

Referring to FIG. 1, the developer supply container 1 comprising a toner cartridge containing a developer and detachably mountable to the image forming apparatus 100 will be described. Further, the description will be made as to the structure of a copying machine (electrophotographic image forming apparatus) of an electrophotographic type as an example of the image forming apparatus 100 including the developer receiving device 300 to which the developer supply container 1 is detachably mountable (dismountable).

In FIG. 1, designated by 101 is an original placed on an original supporting platen glass 102. A light image corresponding to the image information of the original 101 is focused on the surface of the photosensitive drum 104 of electrophotographic photosensitive member as an image bearing member by the way of a plurality of mirrors 13 and a lens 14 of an optical portion 103, by which an electrostatic latent image is formed. The electrostatic latent image is visualized using toner (one component magnetic toner) as a developer (dry powder) by a dry type developing device (one component developing device) 201.

In this embodiment, the developer supplied from the developer supply container 1 is one component magnetic toner, but this is not inevitable to the present invention, and the structure which will be described is usable.

Specifically, when the use is made with the one component developing device to effect the development with one component non-magnetic toner, the supplied developer is one component non-magnetic toner. In addition, when the use is made with two component developing device to effect the development with two component developer containing mixed magnetic carrier and non-magnetic toner, the supplied developer is non-magnetic toner. In this case, the magnetic carrier may be supplied together with the non-magnetic toner, as the developer.

As described hereinbefore, the developing device 201 shown in FIG. 1 develops, with the toner as the developer, the electrostatic latent image formed on the surface of the photosensitive drum 104 as the image bearing member in accordance with the image information of the original. The developing device 201 includes a developing roller 201*f* in addition to a developer hopper 201*a*. The developer hopper 201*a* is provided with a stirring member 201*c* for stirring the developer supplied from the developer supply container 1. The developer stirred by the stirring member 201*c* is fed to a downstream feeding member 201*e* by a feeding member 201*d*.

The developer fed by the feeding members 201*e*, 201*b* is carried on the developing roller 201*f*, and finally is fed to a developing portion where the developing roller 201*f* is opposed to the photosensitive drum 104.

In this embodiment, the toner as the developer is supplied from the developer supply container 1 into the developing device 201, but the toner and the carrier as the developer may be supplied from the developer supply container 1.

Designated by 105-108 in FIG. 1 are feeding cassettes accommodating recording materials 12. Of the feeding cassettes 105-108, a proper one stacking the recording material 12 determined by the information inputted by the user on the liquid crystal operating portion of the image forming apparatus 100 or properly determined on the basis of the size of the original 101 is selected.

One recording material 12 fed by a feeding separating device 105A-108A is fed to registration rollers 110 along the feeding portion 109. Then, the recording material 12 is fed by the registration rollers 110 in timed relation with the rotation of the photosensitive drum 104 and with the scanning operation of the optical portion 103.

Designated by 111 is a transfer charger. Designated by 112 is a separation charger. The developer image (toner image) formed on the surface of the photosensitive drum 104 is transferred onto the recording material 12 by a transfer charger 111. By the separation charger 112, the recording material 12 now carrying the transferred developer image (toner image) is separated from the surface of the photosensitive drum 104.

Thereafter, the recording material 12 fed by the feeding portion 113 is heated and pressed by the fixing portion 114, so that the developer image is fixed on the recording material 12, and then it is passed through a discharging/reversing portion 115 and is discharged onto the discharging tray 117 by the discharging roller 116 in the case of a one-sided copy mode.

In the case of a duplex copy mode, the recording material 12 is passed through the discharging/reversing portion 115 and is partly discharged to the outside of the image forming apparatus 100 by the discharging roller 116 temporarily. Then, at the timing of the recording material 12 is nipped by the discharging rollers 116 after a trailing end of the recording material 12 having passed a flapper 118, the flapper 118 is controlled and the discharging rollers 116 are rotated in the opposite directions. By this, the recording material is re-fed into the image forming apparatus 100. Further, as the this, the recording material is fed through re-feeding portions 119, 120 to the registration roller 110, and thereafter, it is discharged onto the discharging tray 117 along the same feeding path as with the one-sided copy mode.

In the image forming apparatus 100, around the photosensitive drum 104, image forming process equipment such as the developing device 201 as a developing means, a cleaner portion 202 as a cleaning means, a primary charger 203 as a charging means are provided. The developing device 201 develops the electrostatic latent image formed on the surface of the photosensitive drum 104 by the optical portion 103 in accordance with the image information of the original, by depositing the developer on the electrostatic latent image. The primary charger 203 functions to uniformly charge the surface of the photosensitive drum 104 to form the intended electrostatic latent image on the surface of the photosensitive drum 104. The cleaner portion 202 functions to remove the developer remaining on the surface of the photosensitive drum 104.

Figure 2:
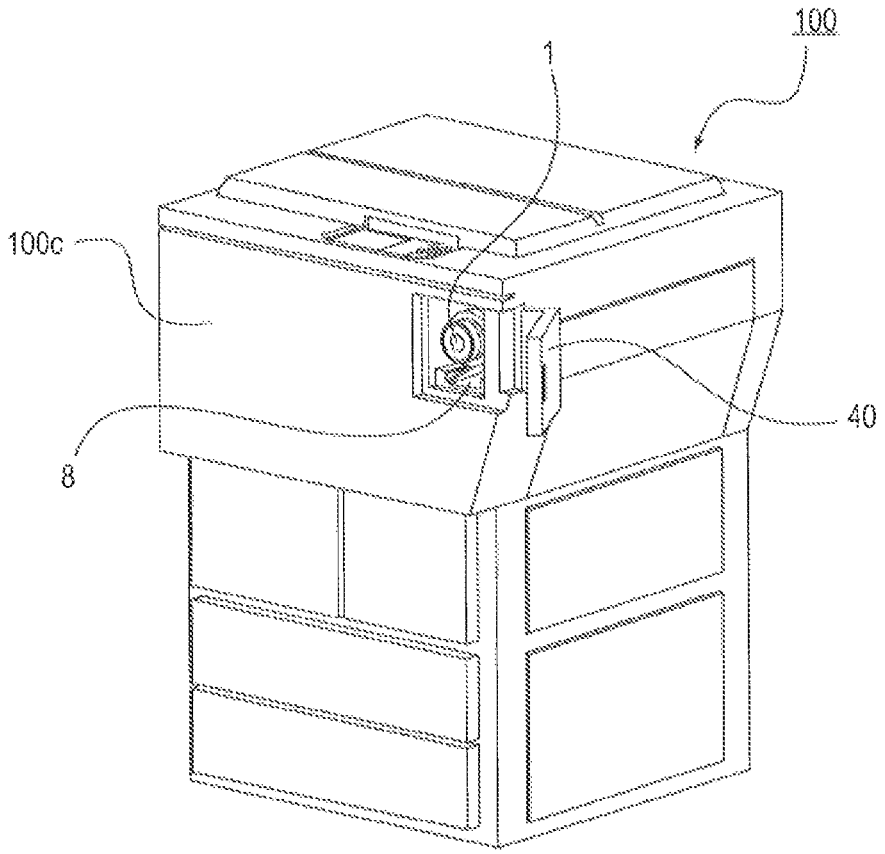
FIG. 2 is a schematic perspective view illustrating the structure of the image forming apparatus provided with the developer supply container according to the present invention.

FIG. 2 shows an outer appearance of the image forming apparatus 100. When the user opens an exchange cover 40 which is a part of an outer casing of the image forming apparatus 100, a part of the developer receiving device 300 shown in FIG. 3 appears. Then, the user inserts the developer supply container 1 into the developer receiving device 300 in the direction indicated by an arrow d, by which the developer supply container 1 is set in a state capable of supplying the developer into the developer receiving device 300.

On the other hand, when the user exchanging the developer supply container 1, the operation in the opposite direction is carried out, by which the developer supply container 1 is removed from the developer receiving device 300 and is taken out. Then, the user may set the fresh developer supply container 1.

The exchange cover 40 is provided exclusively for mounting and dismounting the developer supply container 1 for the exchange, and is opened and closed to mount and dismount the developer supply container 1. For the maintenance of the main assembly of the image forming apparatus 100, a front cover 100*c* shown in FIG. 2 is opened and closed. The exchange cover 40 and the front cover 100*c* may be integral. In such a case, the unshown cover is opened and closed for the exchange of the developer supply container 1 and for the maintenance of the main assembly of the image forming apparatus 100.

<Developer Receiving Device>

Referring to FIG. 3, the structure of the developer receiving apparatus 300 will be described. To the developer receiving device 300 provided in the image forming apparatus 100, the developer supply container 1 shown in FIG. 7 is detachably mountable. As shown in FIG. 3, the developer receiving device 300 is provided with a housing 301 functioning as a mounting portion into which the developer supply container 1 is inserted. In addition, it is provided with a developer reception member 302 having a developer receiving port 302*a* for receiving the developer from the developer supply container 1.

As shown in part (b) of FIG. 3, it is further provided with a buffer portion 303 for storing the developer received through the developer receiving port 302*a* and for feeding the developer into the developing device 201 shown in FIG. 1. Furthermore, as shown in FIG. 3, part (b), it is provided with a holding mechanism 304 for guiding the developer supply container 1 to the mounting position and for holding the developer supply container 1 in the mounting position. Moreover, as shown in FIG. 3, part (b), it is provided with a driving portion 305 including a driving gear for rotating the developer supply container 1, and a phase detecting portion 306 as a detecting means for detecting a rotational phase of the developer supply container 1.

<Housing>

Referring to FIG. 4, the structure of the housing 301 of the developer receiving device 300 will be described. As shown in part (b) of FIG. 4, the housing 301 is provided with an inserting opening 301*a* for receiving the developer supply container 1 shown in FIG. 7. The housing 301 has a length corresponding to the total length of developer supply container 1 shown in FIG. 7 and has an inner shape corresponding to an outer shape of the developer supply container 1.

When the developer supply container 1 is mounted in the housing 301 shown in FIG. 3, the housing 301 covers the entire outer periphery of the developer supply container 1. As shown in part (a) of FIG. 4, the housing 301 is provided with the bottle shutter holding portion 301*b* for holding the position of a bottle shutter 5 of the developer supply container 1 shown in FIG. 8. In addition, as shown in part (a) of FIG. 4, there is provided a releasing projection portion 301*c* engageable with a locking portion 4*i* provided on a part of the holding member (portion-to-be-supported) 4 shown in FIG. 11.

Furthermore, as shown in part (a) of FIG. 4, the housing 301 is provided with a supporting hole 301*d* by which a supporting shaft 304*a*3 for a pulling member 304*a* provided on the holding mechanism 304 shown in FIG. 6 is rotatably supported. Moreover, as shown in part (a) of FIG. 4, the housing 301 is provided with a stopper 301*e* for limiting insertion of the developer supply container 1 in the mounting direction indicated by an arrow d of FIG. 7, at a downstream position with respect to the mounting direction.

<Developer Receiving Portion>

Referring to FIG. 5, the structure of the developer reception member 302 will be described. As shown in Part (a) of FIG. 5, the developer reception member 302 is provided with a developer receiving port 302*a* for receiving the developer, and a receiving port seal 302*b* extending around the developer receiving port 302*a*.

The developer reception member 302 engages with and slides along inclined portion 4*d*, 4*k* provided in the holding member 4 shown in part (b) of FIG. 11, with the mounting operation of the developer supply container 1 shown in FIG. 7 to the housing 301.

There is provided an engaging projection portion 302*c* by which the developer receiving port 302*a* of the developer reception member 302 is displaced to a position opposing to the discharge opening 10*a* of the opening seal 10 shown in shown in FIG. 12. The discharge opening 10*a* of the opening seal 10 shown in FIG. 12 functions as a discharge opening for discharging the developer from the developer accommodating portion 2*a* (developer accommodating portion) of the developer supply container 1 accommodating the developer.

In addition, the developer reception member 302 is provided with an inclined portion 302*d* for contacting a engaging with the guiding portion 5*e* in the form of a recess of the bottle shutter 5 shown in part (b) of FIG. 13. The inclined portion 302*d* includes a projection four alignment between the developer receiving port 302*a* shown in part (a) of FIG. 5 and the developer supply opening 5*b* of the bottle shutter 5 shown in part (b) of FIG. 13, in the mounting operation of the developer supply container 1 shown in FIG. 7.

The inclined portion 302*d* including the projection of the developer reception member 302 shown in part (a) of FIG. 5 is engaged with the guiding portion 5*e* in the form of a recess of the bottle shutter 5 shown in part (b) of FIG. 13. By this, the developer receiving port 302*a* of the developer reception member 302 shown in part (a) of FIG. 5 is brought into fluid communication with the developer supply opening 5*b* of the bottle shutter 5 shown in FIG. 13.

In this manner, by the mounting operation of the developer supply container 1 shown in FIG. 7, the developer receiving port 302*a* of the developer reception member 302 shown in part (a) of FIG. 5 and the discharge opening for discharging the developer from the developer accommodating portion 2*a* of the developer supply container 1 are brought into fluid communication with each other.

The discharge opening for discharging the developer from the developer accommodating portion 2*a* includes the discharge opening 10*a* of the opening seal 10 shown in FIG. 12 and the developer supply opening 5*b* of the bottle shutter 5 shown in part (b) of FIG. 13. By the relative displacement between the developer receiving port 302*a* of the developer reception member 302 and the discharge opening 10*a* of the opening seal 10 in the direction opposite to the arrow d direction of FIG. 7 which is a crossing direction different from the arrow d direction (the mounting direction of the developer supply container 1) of FIG. 7, they are connected.

As shown in FIG. 5, an urging member 302*e* in the form of a coil spring is fitted around the shaft portion 302*f* of the developer reception member 302. As shown in part (b) of FIG. 13, the shaft portion 302*f* of the developer reception member 302 shown in FIG. 5 is inserted into a through-hole 301*f* provided in the housing 301 shown in part (a) of FIG. 4. A top end portion of the urging member 302*e* is contacted to a flange portion 301 *g* around the through-hole 301*f* of the housing 301. By doing so, the developer reception member 302 is normally urged in the downward direction G with respect to the vertical direction (part (b) of FIG. 3).

The receiving port seal 302*b* shown in FIG. 5 is made of urethane foam and is compressed by the bottle shutter 5 shown in FIG. 13 and the developer reception member 302, by which the leakage of the developer in the connecting portion between the bottle shutter 5 and the developer reception member 302 is prevented. In this embodiment, the compression ratio of the receiving port seal 302*b* is 30%.

<Buffer Portion>

Referring to part (b) of FIG. 3, the structure of the buffer portion 303 will be described. As shown in part (b) of FIG. 3, the buffer portion 303 is provided below the developer reception member 302 of the housing 301. There are provided a storage portion 303*a* in fluid communication with the buffer portion 303 to temporarily store the developer, and a feeding member 303*b* for feeding the developer stored in the storage portion 303*a* into the developing device 201.

<Holding Mechanism>

Referring to FIG. 6, the structure of the holding mechanism 304 will be described. As shown in part (a) of FIG. 6, the holding mechanism 304 is provided in the developer receiving device 300 and engages with a holding projection 4*h* provided on the holding member 4 shown in FIG. 11 to retract the developer supply container 1 to the mounting position with the mounting operation of the developer supply container 1.

That holding projection 4*h* provided on the holding member 4 shown in FIG. 11 functions as a holding portion provided at a leading end portion (leading end portion in the mounting direction) in the mounting direction of the arrow d in FIG. 7.

As shown in part (a) of FIG. 6, the holding mechanism 304 is provided with the pulling member 304*a*, an urging member 304*b* for producing an urging force for pulling the developer supply container 1 shown in FIG. 7, and a supporting shaft 304*a*3. The supporting shaft 304*a*3 is inserted into the supporting hole 301*d* provided in the housing 301 shown in part (a) of FIG. 4 so as to be rotatable in the direction indicated by an arrow c in parts (b)-(d) of FIG. 6 about the supporting shaft 304*a*3.

The pulling member 304*a* shown in FIG. 6 is provided with an abutting portion 304*a*1 contacted to a contact portion 6*a* of a protecting member 6 shown in part (a) of FIG. 14 provided at a leading end portion with respect to the mounting direction of the developer supply container 1, with the mounting operation of the developer supply container 1 shown in FIG. 7. In addition, there is provided a suppressing portion 304*a*2 contacting to the contact portion 4*h*1 formed on the holding projection 4*h* of the holding member 4 shown in part (b) of FIG. 11.

The developer supply container 1 shown in FIG. 7 is provided with the contact portion 6*a* contactable to the abutting portion 304*a*1 of the holding mechanism 304 shown in FIG. 6 with the mounting operation of the developer supply container 1 to the image forming apparatus 100 on the protecting member 6 at a leading end portion with respect to the mounting direction of the developer supply container 1. The contact portion 6*a* contactable to the abutting portion 304*a*1 of holding mechanism 304 shown in FIG. 6 is provided at the end surface of the developer supply container 1 with respect to the mounting direction.

From each of the side surfaces of the pulling member 304*a* shown in FIG. 6, a supporting shaft 304*a*3 rotatably supported by the supporting hole 301*d* provided in the housing 301 shown in part (a) of FIG. 4 is projected. As shown in part (a) of FIG. 6, one end portion of the urging member 304*b* in the form of a coil spring is engaged with and supported by an engaging portion 304*c* provided in the pulling member 304*a*. In addition, as shown in part (b) of FIG. 3, the other end portion of the urging member 304*b* is engaged with and supported by a supporting shaft 301*h* provided in the housing 301.

As shown in parts (b)-(d), the pulling member 304*a* shown in FIG. 6 is supported so as to be rotatable about the supporting shaft 304*a*3. Therefore, as shown in parts (b)-(d) of FIG. 6, the positional relationship changes with the rotation of the pulling member 304*a* about the supporting shaft 304*a*3 in the direction of the arrow c in parts (b)-(d) of FIG. 6.

The change of the positional relation is the change of the positional relation between the urging member 304*b* stretched between the engaging portion 304*c* of the pulling member 304*a* and the supporting shaft 301*h* of the housing 301 and the supporting shaft 304*a*3 which provides the rotational center of the pulling member 304*a*.

More specifically, the position of the urging member 304*b* changes from an upstream side to a downstream side of the pulling member 304*a* having the center at the supporting shaft 304*a*3 with respect to the rotational moving direction indicated by the arrow c in parts (b)-(d) of FIG. 6, relative to the supporting shaft 304*a*3 providing the rotational center of the of the pulling member 304*a*.

With the change of the positional relation between the supporting shaft 304*a*3 providing the rotational center of the pulling member 304*a* and the urging member 304*b*, the urging force provided by the tension force of the urging member 304*b* changes.

More particularly, the direction of the rotational force about the supporting shaft 304*a*3 of the pulling member 304*a* changes from the arrow a direction shown in part (b) of FIG. 6 to an arrow b direction shown in part (d) of FIG. 6.

<Driving Portion>

Referring to FIG. 3, the structure of the driving portion 305 will be described. The driving portion 305 including a gear shown in part (a) of FIG. 3 is engaged with a drive receiving portion 7*a* including a gear of a power conversion member 7 shown in FIG. 8 for receiving the rotational force from the driving portion 305 in the mounted position of the developer supply container 1 in the housing 301. The driving portion 305 transmits the driving force to the developer supply container 1.

<Developer Supply Container>

Referring to FIGS. 7 and 8, the structure of the developer supply container 1 will be described. When the developer supply container 1 shown in FIG. 7 is mounted to the mounted position in the housing 301 of the image forming apparatus 100, the driving portion 305 including the gear shown in FIG. 3 is engaged with the drive receiving portion 7*a* including the gear shown in FIG. 7. The developer supply container 1 receives the rotational force from the image forming apparatus 100 to rotate the developer accommodation member 2. By this, the developer is fed to the opening 2*c* shown in part (a) of FIG. 9 by a feeding portion 2*b* projected and extended helically on the inner surface of the developer accommodating portion 2*a*.

On the other hand, the developer supply container 1 shown in FIG. 7 is mounted to the mounted position of the housing 301 of the image forming apparatus 100. Then, the discharge opening 10*a* of the opening seal 10 shown in FIG. 12, the developer supply opening 5*b* of the bottle shutter 5 shown in FIG. 13, and the developer receiving port 302*a* of the developer reception member 302 shown in part (a) of FIG. 5 are brought into fluid communication with each other.

The developer flows through the opening 2*c* shown in part (a) of FIG. 9, the discharge opening 10*a* of the opening seal 10 shown in FIG. 12, and the developer supply opening 5*b* of the bottle shutter 5 shown in FIG. 13. Further, the developer is fed through the developer receiving port 302*a* of the developer reception member 302 shown in part (a) of FIG. 5 and the buffer portion 303 provided in the housing 301 shown in part (b) of FIG. 3, and is stored in the storage portion 303*a*, and then, it is supplied into the developing device 201 by the feeding member 303*b* from the storage portion 303*a*.

As shown in FIG. 8, the developer supply container 1 includes the developer accommodation member 2 accommodating the developer and the feeding member 3 shown in FIG. 10 The developer supply container 1 is provided with the holding projection 4*h* of the holding member 4 (holding portion) shown in FIG. 11, the bottle shutter 5 shown in FIG. 13, the protecting member 6 shown in FIG. 14, the power conversion member 7 shown in FIG. 15 and the reciprocating member 8 shown in FIG. 16.

As shown in FIG. 8, the developer supply container 1 includes an expansion-and-contraction member 9 shown in FIG. 17 as a volume change means for changing the pressure in the developer supply container 1, by changing an inside volume of the developer supply container 1. In addition, as shown in FIG. 8, the developer supply container 1 is provided with an opening seal 10 shown in FIG. 12, and a rotation seal 11 or the like.

<Developer Accommodation Member>

Referring to FIG. 9, the structure of the developer accommodation member 2 of the developer supply container 1 will be described. As shown in FIG. 9, the developer accommodation member 2 includes a developer accommodating portion 2*a* for accommodating the developer, and the feeding portion 2*b* for feeding the developer with the rotation of the developer accommodation member 2. It is further provided with the opening 2*c* for discharging the developer fed thereinto, and a cylindrical small diameter portion 2*f* provided between the developer accommodating portion 2*a* and the opening 2*c*.

This is further provided with a rotation holding portion 2*d* (a plurality of ribs) for holding the rotation of the developer accommodation member 2, a portion-to-be-engaged 2*e* for receiving the rotational driving force through engagement with the engaging portion 7*c* of the power conversion member 7 shown in FIG. 15 in an outer peripheral surface side of the small diameter portion 2*f*. The feeding portion 2*b* includes a helical projection projecting inside the developer accommodating portion 2*a*, and is effective to feed the developer in the direction indicated by the arrow d of FIG. 7 with the rotation of the developer accommodation member 2.

<Feeding Member>

Referring to FIGS. 8 and 10, the structure of the feeding member 3 will be described. As shown in FIG. 8, the feeding member 3 shown in FIG. 10 is fixed to the developer accommodation member 2. It includes an developer lifting portion 3*a* for lifting the developer fed to the neighborhood of the opening 2*c* of the developer accommodating portion 2*a* of the developer accommodation member 2, with the rotation of the feeding member 3. Moreover, it is provided with a feeding plate 3*b* for feeding the developer lifted by the developer lifting portion 3*a*, along the inclined surface.

<Holding Portion>

Referring to FIG. 11, the structure of the holding projection 4*h* of the holding member 4 as the holding portion will be described. As shown in part (a) of FIG. 11, the holding member 4 includes a cylindrical engaging portion 4*b* for rotatably holding the developer accommodation member 2 by the engaging with the rotation holding portion 2*d* of the developer accommodation member 2 shown in FIG. 9. A part of the engaging portion 4*b* is provided with a plurality of elastically deformable locking claws 4*n* arranged along the cylindrical surface of the engaging portion 4*b*, for locking with the rib projection of the rotation holding portion 2*d* shown in FIG. 9.

Further, as shown in part (c) of FIG. 11, the holding member 4 is provided with a storage portion 4*a* for storing the developer fed by the feeding member 3 shown in FIG. 10. A free end portion of the storage portion 4*a* is provided with a seat 4*f* on which the opening seal 10 having the discharge opening 10*a* shown in FIG. 12 is stuck.

A screw portion 4*c* screwing with a screw portion 9*b* of the expansion-and-contraction member 9 shown in FIG. 17 is formed in the downstream side of the engaging portion 4*b* shown in part (c) of FIG. 11 with respect to the mounting direction of the developer supply container 1 indicated by the arrow d in FIG. 7.

As shown in part (b) of FIG. 11, the holding member 4 is provided with the inclined portions 4*d*, 4*k* slidably engageable with the engaging projection portion 302*c* of the developer reception member 302 shown in FIGS. 3 and 5. Furthermore, as shown in part (c) of FIG. 11, the holding member 4 is provided with the bottle shutter holding portion 4*e* into which the bottle shutter 5 shown in FIG. 13 is slidably inserted. As shown in part (c) of FIG. 11, the holding member 4 is provided with a shielding portion 4 *g* for shielding the developer supply opening 5*b* of the bottle shutter 5 shown in FIG. 13, when the developer supply container 1 is not mounted.

In addition, as shown in parts (a) and (b) of FIG. 11, the holding member 4 is provided at a free end portion of a locking arm 4*m* with the locking portion 4*i* for limiting the displacement of the bottle shutter 5 by the engagement with a locking projection portion 5*d* of the bottle shutter 5 shown in FIG. 13.

A downstream side leading end portion of the holding member 4 shown in FIG. 11 with respect to the mounting direction of the developer supply container 1 indicated by the arrow d in FIG. 7 is provided with the holding projection 4*h*. The holding projection 4*h* is provided with the contact portion 4*h*1 contacting to the suppressing portion 304*a*2 of the pulling member 304*a* of the holding mechanism 304 provided in the developer receiving device 300 shown in FIG. 6.

The contact portion 4*h*1 of the holding projection 4*h* shown in FIG. 11 is provided in the upstream side with respect to the mounting direction of the developer supply container 1 indicated by the arrow d in FIG. 7. The contact portion 4*h*1 receive a pulling force from the pulling member 304*a* by the contact of the suppressing portion 304*a*2 by the rotation of the pulling member 304*a* of the holding mechanism 304 shown in FIG. 6 about the supporting shaft 304*a*3 by the tension force of the urging member 304*b*.

<Opening Seal>

Referring to FIG. 12, the structure of the opening seal 10 will be described. The opening seal 10 shown in FIG. 12 is stuck on the seat 4*f* of the holding member 4 shown in part (c) of FIG. 11 by a double coated tape 10*c* shown in part (b) of FIG. 12. As shown in part (a) of FIG. 12, the opening seal 10 is provided with the discharge opening 10*a* formed as a through-hole in a part of the seal surface 10*b*.

When the developer supply container 1 shown in FIG. 7 is mounted in the mounted position in the housing 301, discharge opening 10*a* the shown in FIG. 12 and the developer supply opening 5*b* in the form of the through-hole of the bottle shutter 5 shown in FIG. 13 are in fluid communication with each other.

When the developer supply container 1 shown in FIG. 7 is not mounted in the mounted position, the sealing portion 5*a* of the bottle shutter 5 shown in part (a) of FIG. 13 is press-contacted by the elastic force bottle shutter 5 to the seal surface 10*b* of the opening seal 10 shown in part (a) of FIG. 12. By this, the developer leakage from the storage portion 4*a* of the holding member 4 shown in part (c) of FIG. 11 is prevented.

In this embodiment, a compression ratio to the seal surface 10*b* is approx. 20% when the sealing portion 5*a* of bottle shutter 5 is press-contacted to the seal surface 10*b* of the opening seal 10. The compression ratio of the seal surface 10*b* of the opening seal 10 can be properly adjusted by adjusting the height of the seat 4*f* of the holding member 4 shown in part (c) of FIG. 11.

<Bottle Shutter>

Referring to FIG. 13, the structure of the bottle shutter 5 will be described. The bottle shutter 5 shown in FIG. 13 is assembled into the bottle shutter holding portion 4*e* of the holding member 4 shown in part (c) of FIG. 11 by being slidably inserted in the left-right direction on part (c) of FIG. 11. By this, the sealing portion 5*a* of the bottle shutter 5 moves between an unsealing position for unsealing the discharge opening 10*a* of the opening seal 10 shown in FIG. 12 and a sealing position for sealing the discharge opening 10*a*. The bottle shutter 5 is movable in the mounting direction of the developer supply container 1 indicated by the arrow d in FIG. 7 and in the dismounting direction opposite to the arrow d direction of FIG. 7.

As shown in part (a) of FIG. 13, the bottle shutter 5 is provided with the sealing portion 5*a* for preventing the leakage of the developer by press-contacting to the seal surface 10*b* of the opening seal 10 shown in part (a) of FIG. 12, in the sealing position. Further, the developer supply opening 5*b* enabling the supply of the developer by communicating with the discharge opening 10*a* of the opening seal 10 shown in FIG. 12 in the open position is provided.

In addition, as shown in FIG. 13, the bottle shutter 5 is provided with a holding projection 5*c* engaging with the bottle shutter holding portion 301*b* formed in the housing 301 of the developer receiving device 300 shown in part (a) of FIG. 4, in the process of the mounting operation of the developer supply container 1 shown in FIG. 7.

Further, as shown in FIG. 13, the bottle shutter 5 is provided with the locking projection portion 5*d* engaged with the locking portion 4*i* of the holding member 4 shown in FIG. 11. As shown in part (b) of FIG. 13, the bottle shutter 5 is provided with the guiding portion 5*e* to be abutted by the inclined portion 302*d* in the form of the projection provided on the outer periphery of the developer receiving port 302*a* of the developer reception member 302 shown in FIG. 5. The guiding portion 5*e* in the form of the recess is formed at the outer peripheral surface of the developer supply opening 5*b*, and regulates the relative position between the bottle shutter 5 and the developer reception member 302.

The inclined portion 302*d* in the form of the projection of the developer reception member 302 shown in FIG. 5 and the guiding portion 5*e* in the form of the recess of the bottle shutter 5 shown in part (b) of FIG. 13 are engaged with each other. By this, the axis of the developer receiving port 302*a* of the developer reception member 302 shown in FIG. 5 and the axis of the developer supply opening 5*b* of the bottle shutter 5 shown in part (b) of FIG. 13 become substantially coaxial with each other.

In this embodiment, the diameter of the developer supply opening 5*b* of the bottle shutter 5 shown in FIG. 13 is approx. 2.5 mm. By this, the scattering of the developer with the result of contamination with the developer can be prevented when the bottle shutter 5 is opened and closed with the mounting and demounting operation of the developer supply container 1 shown in FIG. 7 to the developer receiving device 300.

<Protecting Member>

Referring to FIGS. 7, 8 and 14, the structure of the protecting member 6 will be described. As shown in FIGS. 7 and 8, the protecting member 6 shown in FIG. 14 is assembled with the holding member 4 so as to cover the entirety of the outer peripheries of the reciprocating member 8 shown in FIG. 16, the expansion-and-contraction member 9 shown in FIG. 17, the holding member 4 shown in FIG. 11 and the like. By this, the developer supply container 1 shown in FIG. 7 is protected from vibration and/or shock during transportation.

In addition, as shown in part (a) of FIG. 14, the downstream side end surface of the developer supply container 1 with respect to the mounting direction indicated by the arrow d in FIG. 7 is provided with the contact portion 6*a* contacting the abutting portion 304*a*1 of the pulling member 304*a* provided in the holding mechanism 304 shown in FIG. 6.

As shown in part (b) of FIG. 14, the protecting member 6 is provided with an engaging portion 6*b* engaging with the holding member 4 shown in FIG. 11. Further, there is provided a rotation regulating portion 6*c* into which an arm portion 8*c* of the reciprocating member 8 shown in FIG. 16 is slidably inserted in the longitudinal direction (left-right direction in part (a) of FIG. 16) to limit the rotation of the reciprocating member 8.

<Power Conversion Member>

Referring to FIGS. 8 and 15, the structure of the power conversion member 7 will be described. As shown in FIG. 8, the power conversion member 7 is a substantially cylindrical member provided so as to cover the rotation holding portion 2*d* of the developer accommodation member 2. As shown in part (a) of FIG. 15, the power conversion member 7 is provided with an engaging portion 7*e* engaging with the rotation holding portion 2*d* of the developer accommodation member 2 shown in FIG. 8. At the outer peripheral surface of the engaging portion 7*e*, the drive receiving portion 7*a* for receiving the rotational force from the driving portion 305 of the main assembly of the image forming apparatus 100 shown in FIG. 3 is formed.

Furthermore, at the outer peripheral surface of the power conversion member 7, a cam groove 7*b* engaging with the projection 8*b* provided projected inwardly at each of the opposite end portions of the arm portion 8*c* of the U-shaped reciprocating member 8 shown in part (b) of FIG. 16 is formed. The power conversion member 7 is rotated by the rotational force received by the drive receiving portion 7*a*.

At this time, the projections 8*b* provided at the opposite end portions of the arm portion 8*c* of the reciprocating member 8 slide along the cam groove 7*b* provided in the outer peripheral surface of the power conversion member 7. By this, the arm portion 8*c* of the reciprocating member 8 moves in the direction of the arrow d of FIG. 7 or in the direction opposite to the arrow d direction of FIG. 7, along the rotation regulating portion 6*c* of the protecting member 6 shown in FIG. 14. By this, the rotational motion of the power conversion member 7 can be conversion to a reciprocating motion along the rotational axis direction of the power conversion member 7.

In addition, as shown in part (c) of FIG. 15, an inner surface of the power conversion member 7 is provided with the engaging portion 7*c* including a groove portion for transmitting to the developer accommodation member 2 the rotational force received by the drive receiving portion 7*a* through engagement with the portion-to-be-engaged 2*e* in the form of the rib projection of the developer accommodation member 2 shown in FIG. 8.

<Reciprocating Member>

Referring to FIG. 16, the structure of the reciprocating member 8 will be described. As shown in part (b) of FIG. 16, the U-shaped reciprocating member 8 is provided with an engaging portion 8*a* for reciprocating the expansion-and-contraction member 9 integrally with the reciprocating member 8 by engagement with a grip portion 9*c* of the expansion-and-contraction member 9 shown in FIG. 17. Each of the opposite end portions of the arm portion 8*c* is provided with the projection 8*b* which is engaged with the cam groove 7*b* of the power conversion member 7 shown in part (a) of FIG. 15 to receive the reciprocating motion in the rotational axis direction of the power conversion member 7.

The projection 8*b* and the engaging portion 8*a* of the reciprocating member 8 are connected by the arm portion 8*c* which is engaged in the rotation regulating portion 6*c* of the protecting member 6 shown in FIG. 14 to limit the rotation.

As shown in part (a) of FIG. 16, the arm portion 8*c* of the reciprocating member 8 is provided with a U-shaped elastic deformation portion 8*d* contacting an internal wall surface of the rotation regulating portion 6*c* of the protecting member 6 shown in FIG. 14 with a vertical urging force. The elastic deformation portion 8*d* positively contacts by the elastic force thereof the internal wall surface of the rotation regulating portion 6*c*, so that the play between the rotation regulating portion 6*c* and the arm portion 8*c* is removed, and therefore, the vibration and the noise produced by the reciprocal motion of the reciprocating member 8 along the rotation regulating portion 6*c* of the protecting member 6 can be prevented.

<Expansion-and-Contraction Portion>

Referring to FIG. 17, the structure of the expansion-and-contraction member (pump portion) 9 as the volume changing means will be described. As shown in FIG. 17, the expansion-and-contraction member 9 includes a cylindrical opening 9*a* which opens at one end, a screw portion 9*b* provided on the outer peripheral surface around the opening 9*a*, a bellow-like expansion-and-contraction portion 9*d* connected to the other end opposite from the opening 9*a*, a grip portion 9*c* connected to the expansion-and-contraction portion 9*d*.

The opening 9*a* side of the expansion-and-contraction member 9 is connected to the holding member 4 by screwing with the screw portion 4*c* of the holding member 4 shown in part (c) of FIG. 11 at the screw portion 9*b* provided on the outer peripheral surface around the opening 9*a*. The grip portion 9*c* side of the expansion-and-contraction member 9 is engaged with the engaging portion 8*a* of the reciprocating member 8 shown in FIG. 16 at the grip portion 9*c*, so that it is disposed between the holding member 4 and the reciprocating member 8.

The expansion-and-contraction member 9 receives the reciprocating motion of the reciprocating member 8 in the left-right directions shown in part (a) of FIG. 16, so that the expansion-and-contraction portion 9*d* is expanded and contracted. As shown in FIG. 8, the expansion-and-contraction member 9 shown in FIG. 17, the cylindrical portion 4*j* of the holding member 4 shown in FIG. 11, the cylindrical power conversion member 7 shown in FIG. 15 and the opening 2*c* of the developer accommodating portion 2*a* shown in FIG. 9 are in fluid communication with each other in the respective hollow inside portions and are sealed otherwise.

The developer is discharged using the air flow produced by suction and discharging function caused by the expansion and contraction of the expansion-and-contraction portion 9*d* of the expansion-and-contraction member 9. The developer is discharged from the discharge opening 10*a* of the opening seal 10 shown in FIG. 12 stuck on the seat 4*f*, through the storage portion 4*a* provided below the cylindrical portion 4*j* of the holding member 4 shown in part (c) of FIG. 11. Further, the developer is discharged into the buffer portion 303 shown in part (b) of FIG. 3 from the developer receiving port 302*a* of the developer reception member 302 shown in FIG. 5, through the discharge opening of the developer supply opening 5*b* of the bottle shutter 5 shown in FIG. 13.

As shown in FIG. 3, it is connected with the developer receiving port 302*a* of the developer reception member 302 shown in FIG. 5 provided in the developer receiving device 300 side of the image forming apparatus 100.

The developer supply opening 5*b* of the bottle shutter 5 shown in FIG. 13 and the discharge opening 10*a* of the opening seal 10 shown in FIG. 12 are in the form of through-holes having diameters not more than 4 mm or having cross-sectional areas corresponding to the cross-sectional area of the 4 mm diameter hole. The developer supply opening 5*b* of the bottle shutter 5 shown in FIG. 13 is a discharge opening for discharging the developer from the developer accommodating portion 2*a*.

<Mounting Operation of Developer Supply Container>

Referring to FIGS. 3-7 and 11-14, the mounting operation of the developer supply container 1 to the developer receiving device 300 will be described. Part (b) of FIG. 6 illustrates a positional relation between the pulling member 304*a* and the urging member 304*b* at the time of the starting of the mounting of the developer supply container 1. Part (c) of FIG. 6 illustrates a positional relation between the pulling member 304*a* and the urging member 304*b* in the process of mounting of the developer supply container 1. Part (d) of FIG. 6 illustrates a positional relation between the pulling member 304*a* and the urging member 304*b* when the mounting of the developer supply container 1 is completed.

As shown in FIG. 7, the developer supply container 1 is mounted in the direction indicated by the arrow d in FIGS.

3 and 7 relative to the housing 301 shown in FIG. 3. With the mounting operation of the developer supply container 1, the holding projection 5*c* of the bottle shutter 5 shown in FIG. 13 is engaged with the bottle shutter holding portion 301*b* in the form of the groove of the housing 301 shown in FIG. 4, so that the position of the bottle shutter 5 is limited relative to the housing 301.

At this time, the developer reception member 302 shown in FIG. 3 is spaced from the developer supply container 1. In addition, the abutting portion 304*a*1 of the holding mechanism 304 shown in FIG. 6 is out of contact with the contact portion 6*a* of the protecting member 6 shown in FIG. 14.

Therefore, the pulling member 304*a* of the holding mechanism 304 shown in FIG. 6 is urged in the direction of the arrow a in part (b) of FIG. 6 about the supporting shaft 304*a*3 by the tension force of the urging member 304*b*. And, it is locked by an unshown stopper provided on the frame of the developer receiving device 300. By this, it is retained in the attitude at the initial position shown in part (b) of FIG. 6. Further, the driving portion 305 shown in FIG. 3 and the drive receiving portion 7*a* shown in FIG. 7 are not engaged with each other, so that the driving force is not transmitted from the image forming apparatus 100 side to the developer supply container 1.

The developer supply container 1 is further inserted in the direction of the arrow d in FIGS. 3 and 7. Then, the holding projection 5*c* of the bottle shutter 5 shown in FIG. 13 provided on the developer supply container 1 is engaged with and locked by the bottle shutter holding portion 301*b* in the form of the groove of the housing 301 shown in part (a) of FIG. 4. Only the bottle shutter 5 is held at the position.

On the other hand, the developer supply container 1 except for the bottle shutter 5 further displaces in the direction of the arrow d in part (a) of FIG. 3, relative to the developer receiving device 300.

And, the contact portion 6*a* of the protecting member 6 shown in FIG. 14 contacts to the abutting portion 304*a*1 of the pulling member 304*a* shown in FIG. 6. As shown in part (c) of FIG. 6, the spring pulling member 304*a* is rotated in the direction indicated by the arrow c of part (c) of FIG. 6 about the supporting shaft 304*a*3 by the insertion force of the user against the tension force of the urging member 304*b*.

At this time, as shown in part (b) of FIG. 6, with the attitude at the initial position at the time of the starting of the mounting of the developer supply container 1, the urging member 304*b* is in the upstream side of the supporting shaft 304*a*3 of the pulling member 304*a* with respect to the direction of the arrow c which is the rotational direction of the pulling member 304*a*. Therefore, the pulling member 304*a* is urged in the direction of the arrow a of part (b) of FIG. 6 by a component force of the urging force of the urging member 304*b*.

Therefore, with the mounting operation, the developer supply container 1 receive the urging force in the direction opposite to the direction of the arrow d of FIG. 7 through the contact portion 6*a* of the protecting member 6 shown in FIG. 14 by the tension force (urging force) of the urging member 304*b* of the holding mechanism 304 shown in FIG. 6. At this time, the user executing the mounting operation of the developer supply container 1 receive a resisting force in the direction opposite to the arrow d of FIG. 7 by the tension force of the urging member 304*b* of the holding mechanism 304 shown in part (a) of FIG. 6, when the user inserts the developer supply container 1 in the direction of the arrow d of FIG. 7.

In this embodiment, from the standpoint of the mounting operation property of the developer supply container 1, the urging force by the tension force of the urging member 304*b* which is a source of the resisting force in the direction opposite to the arrow d of FIG. 7, when the developer supply container 1 is inserted in the direction of the arrow d of FIG. 7 is approx. 20N. In addition, the developer reception member 302 shown in FIG. 3 is spaced from the developer supply container 1. Further, the driving portion 305 shown in FIG. 3 and the drive receiving portion 7*a* shown in FIG. 7 of not engaged with each other, and therefore, the driving force is not transmitted from the image forming apparatus 100 to the developer supply container 1.

Then, the developer supply container 1 is inserted in the direction of the arrow d of FIG. 7 against the urging force in the direction opposite to the direction of the arrow d of FIG. 7 produced by the tension force of the urging member 304*b* of the holding mechanism 304 shown in part (a) of FIG. 6. At this time, the developer supply container 1 is inserted in the direction indicated by the arrow d of FIG. 7 in the state the contact portion 6*a* of the protecting member 6 shown in part (a) of FIG. 14 is in contact with the abutting portion 304*a*1 of the pulling member 304*a* shown in FIG. 6.

At this time, the contact portion 6*a* of the protecting member 6 shown in FIG. 14 is contacted to the abutting portion 304*a*1 of the pulling member 304*a* shown in FIG. 6 and is pushed in the direction of the arrow d of FIG. 7. By this, as shown in part (c) of FIG. 6, the pulling member 304*a* is rotated in the direction indicated by the arrow c of part (c) of FIG. 6 about the supporting shaft 304*a*3.

Therefore, as shown in part (c) of FIG. 6, the urging member 304*b* is displaced to the position extending through the supporting shaft 304*a*3, and the urging force by the tension force of the urging member 304*b* functions only in the direction of construction of the urging member 304*b*, and the component force thereof does not work in the rotational direction of the pulling member 304*a*. For this reason, when the pulling member 304*a* is in the position shown in part (c) of FIG. 6, the user does not receive the resisting force produced by the tension force of the urging member 304*b* when the user inserts the developer supply container 1 in the direction indicated by the arrow d of FIG. 7.

Here, the inclined portion 4*d*, 4*k* of the holding member 4 of the developer supply container 1 shown in FIG. 11 and the engaging projection portion 302*c* Of the developer reception member 302 shown in FIG. 3 are engaged with each other, so that the engaging projection portion 302*c* makes sliding movement along the guide groove 4*p* provided between the inclined portions 4*d*, 4*k*. By this, the developer reception member 302 displaces upwardly in part (b) of FIG. 3 against the expanding force of the urging member 302*e* in the form of the coil spring shown in part (b) of FIG. 3.

At this time, at the discharge opening 10*a* of the opening seal 10 shown in FIG. 12 stuck on the seat 4*f* of part (c) of FIG. 11, the sealing portion 5*a* of the bottle shutter 5 shown in FIG. 13 is press-contacted, so that the discharge opening 10*a* is sealed. Thus, the developer stored in the storage portion 4*a* is not discharged through the discharge opening 10*a*.

In the attitude and position shown in part (c) of FIG. 6, the driving portion 305 shown in FIG. 3 is out of engagement with the drive receiving portion 7*a* shown in FIG. 7, and therefore, the driving force is not transmitted to the developer supply container 1 from the image forming apparatus 100.

When the developer supply container 1 is further inserted in the direction of the arrow d of FIG. 7, the pulling member 304*a* rotates in the direction indicated by the arrow c of part (d) of FIG. 6 about the supporting shaft 304*a*3, as shown in part (d) of FIG. 6. At this time, the suppressing portion 304*a*2 shown in FIG. 6 contacts to the contact portion 4*h*1 formed on the holding projection 4*h* of the holding member 4 shown in FIG. 11.

At this time, the urging member 304*b* shown in part (d) of FIG. 6 displaces to a position in the downstream side of the supporting shaft 304*a*3 which is the rotation axis of the pulling member 304*a* with respect to the rotational direction indicated by the arrow c of part (d) of FIG. 6. By this, the pulling member 304*a* rotates in the direction indicated by the arrow c of part (d) of FIG. 6 about the supporting shaft 304*a*3 by the component force of the urging force produced by the tension force of the urging member 304*b*.

Therefore, the component force of the urging force of the urging member 304*b* in the direction of the arrow d of FIG. 7 is applied to the developer supply container 1 through the contact portion 4*h*1 of the holding member 4 shown in FIG. 11 by the suppressing portion 304*a*2 of the pulling member 304*a*. Thus, the developer supply container 1 is pulled in by the component force of the urging force of the urging member 304*b* until the contact portion 6*a* of the protecting member 6 shown in part (a) of FIG. 14 abuts to the stopper 301*e* of the housing 301 shown in FIG. 3.

By this, the developer supply container 1 is pressed against the stopper 301*e* of the housing 301 shown in FIG. 3 by the urging force of the urging member 304*b*, so that it is retained in the mounted position.

The state of the developer supply container 1 in the mounted position shown in part (d) of FIG. 6 will be described. A contact side 304*a*4 of the suppressing portion 304*a*2 contacting the contact portion 4*h*1 of the holding member 4 of the pulling member 304*a* shown in FIG. 11 is inclined relative to the horizontal direction by such a predetermined angle that a component force of urging the developer supply container 1 downwardly with respect to the vertical direction through the holding member 4 is produced.

In this embodiment, the connecting portion between the discharge opening and the engaging projection portion 302*c* is at a level below the contact portion 4*h*1. Therefore, the contact property between the discharge opening and the engaging projection portion 302*c* can be enhanced. That is, the urging force is preferably applied in the connecting direction between the discharge opening and the engaging projection portion 302*c*.

By this, the developer supply container 1 is urged relative to the housing 301 downwardly in part (b) of FIG. 3, and the developer supply container 1 it is stably held at the mounted position. By this, the holding projection 4*h* of the holding member 4 as the holding portion shown in FIG. 11 receive a downward retaining force in part (b) of FIG. 3 by the holding mechanism 304 shown in part (b) of FIG. 3.

The state of the developer supply container 1 in the mounted position shown in part (d) of FIG. 6 will be further described. The developer receiving port 302*a* of the developer reception member 302 shown in part (a) of FIG. 3 the developer supply opening 5*b* formed in the bottle shutter 5 of the developer supply container 1 shown in FIG. 13 and the discharge opening 10*a* formed in the opening seal 10 shown in FIG. 12 are in fluid communication with each other.

Further, the inclined portion 302*d* in the form of the projection formed in the developer reception member 302 shown in FIG. 5 is guided into the guiding portion 5*e* in the form of the recess formed in the bottle shutter 5 shown in part (b) of FIG. 13. By this, the axis of the developer supply opening 5*b* shown in FIG. 13 and the axis of the developer receiving port 302*a* shown in part (a) of FIG. 5 are substantially coaxial with each other.

In this manner, the positional accuracies in the horizontal direction and the vertical direction in the communication between the developer supply opening 5*b* formed in the bottle shutter 5 in the developer supply container 1 side and the developer receiving port 302*a* of the developer reception member 302 of the image forming apparatus 100 side is improved.

That is, the holding mechanism 304 holds the holding member 4 as the holding portion. By this, in the horizontal direction (the inserting direction in which the developer supply container 1 is inserted into the developer receiving device 300) and the vertical direction (the connecting direction in which the discharge opening connects the engaging projection portion 302*c*), the following can be said. The accuracy in the positioning of the developer supply container 1 relative to the developer receiving device 300 is enhanced.

The therefore, the opening diameter of the discharge opening 10*a* of the opening seal 10 shown in FIG. 12 which is the discharge opening for discharging the developer from the developer accommodating portion 2*a* can be reduced. In addition, the opening diameter of the developer supply opening 5*b* of the bottle shutter 5 shown in FIG. 13 can be reduced. Further, the opening diameter of the developer receiving port 302*a* of the developer reception member 302 shown in part (a) of FIG. 5 can be reduced.

The opening diameter of the discharge opening 10*a* of the opening seal 10 shown in FIG. 12 which is the discharge opening for discharging the developer from the developer accommodating portion 2*a* is as follows. Further, the opening diameter of the developer supply opening 5*b* of the bottle shutter 5 shown in FIG. 13 is as follows. Furthermore, the opening diameter of the developer receiving port 302*a* of the developer reception member 302 shown in part (a) of FIG. 5 is as follows. They are through-holes having diameters not more than 4 mm, or through-holes having cross-sectional areas corresponding to the diameters.

The driving portion 305 shown in FIG. 3 and the drive receiving portion 7*a* of the developer supply container 1 shown in FIG. 7 are engaged with each other. That is, the developer supply container 1 shown in FIG. 7 is rotated by the driving force received from the driving portion 305 shown in FIG. 3, and the developer in the developer supply container 1 can be discharged.

In this embodiment, the opening diameter of the developer supply opening 5*b* of the bottle shutter 5 shown in FIG. 13 provided in the developer supply container 1 side is approx. 2.5 mm (diameter) from the standpoint of the developer supply property and the prevention of the scattering of the developer.

Therefore, the state of the fluid communication between the discharge opening 10*a* of the opening seal 10 shown in FIG. 12, the developer supply opening 5*b* of the bottle shutter 5 shown in FIG. 13, the developer receiving port 302*a* of the developer reception member 302 shown in part (a) of FIG. 5 is as follows.

The opening diameter of the developer supply opening 5*b* of the bottle shutter 5 shown in FIG. 13 provided in the developer supply container 1 side is very small, that is, approx. 2.5 mm.

In such a case, the maintenance of the mounted position of the developer supply container 1 is very important. In addition, it is very important to maintain the communication state and/or the connection state of the discharge opening 10*a* of the opening seal 10 shown in FIG. 12 in the developer supply container 1 side. Furthermore, it is very important to maintain the communication state and the connection state of the developer supply opening 5*b* of the bottle shutter 5 Shown in FIG. 13. Moreover, it is very important to maintain the communication state and the connection state of the developer receiving port 302*a* of the developer reception member 302 shown in part (a) of FIG. 3 in the image forming apparatus 100 side.

For example, if the developer supply opening 5*b* and the developer receiving port 302*a* having the diameters of 2.5 mm are deviated from the regular communication position by approx. 1 mm in the mounting direction of the developer supply container 1, an opening area through which the developer can be supplied is remarkably reduced.

In this embodiment, the developer supply container 1 and the developer receiving device 300 are as follows. When the developer supply container 1 shown in part (d) of FIG. 6 is in the mounting-completed position, the positions of the holding projection 4*h* of the holding member 4 shown in FIG. 11 and the suppressing portion 304*a*2 of the holding mechanism 304 shown FIG. 3 are as follows, as shown in FIG. 3. The positions relative to the developer supply opening 5*b* of the bottle shutter 5 shown in FIG. 13 and the developer receiving port 302*a* of the developer reception member 302 shown in FIG. 3 are as follows. They are disposed in the positions opposed to the current drive receiving portion 7*a* shown in FIG. 7 and the driving portion 305 shown in FIG. 3.

That is, the holding projection 4*h* of the holding member 4 as the holding portion shown in FIG. 11 is as follows. The positioning relative to the discharge opening 10*a* of opening seal 10 shown in FIG. 12 as the discharge opening for discharging the developer from the developer accommodating portion 2*a* and the developer supply opening 5*b* of the bottle shutter 5 shown in FIG. 13 is as follows. It is disposed opposed to the drive receiving portion 7*a* with respect to the direction of the arrow d of FIG. 7 which is the rotation axial direction of the drive receiving portion 7*a* shown in FIG. 7.

In addition, as shown in FIG. 8, the holding projection 4*h* of the holding member 4 as the holding portion shown in FIG. 11 is in the leading end side of the developer supply container 1 with respect to the mounting direction.

Therefore, in the mounting operation of the developer supply container 1, the pulling member 304*a* of the holding mechanism 304 is rotated by the urging force of the urging member 304*b* shown in FIG. 3. The holding projection 4*h* of the holding member 4 shown in FIG. 11 mounted on the leading end side of the developer supply container 1 is pulled in the arrow d direction of part (a) of FIG. 3 by the pulling member 304*a* of the holding mechanism 304.

By this, the contact portion 6*a* of the protecting member 6 provided at the leading end portion of the developer supply container 1 shown in FIG. 7 is pulled in until the contact portion 6*a* abuts to the stopper 301*e* of the housing 301. By this, the developer supply opening 5*b* of the bottle shutter 5 shown in FIG. 13 and the developer receiving port 302*a* of the developer reception member 302 shown in part (a) of FIG. 3 are assuredly brought into communication with each other.

In this embodiment, the drive receiving portion 7*a* shown in FIG. 7 includes the gear, and the driving portion 305 shown in FIG. 3 includes the gear. As shown in FIG. 3, the driving portion 305 is positioned in the upper portion of the developer supply container 1. By doing so, the rotational force from the driving portion 305 is received in the upper position of the drive receiving portion 7*a*.

Therefore, the developer accommodation member 2 shown in FIG. 7 is rotated by the rotational force received through the power conversion member 7. In addition, the power conversion member 7 receive a reaction force of the driving force from the driving portion 305, in the downward direction in part (b) of FIG. 3 and the reaction force may produce vibration and/or wobbly motion. There is a liability of the influence to the connection state between the developer supply opening 5*b* of the bottle shutter 5 shown in FIG. 13 and the developer receiving port 302*a* of the developer reception member 302 shown in part (a) of FIG. 3.

The vibration and/or wobbly motion of the developer supply container 1 caused by the reaction force of the driving force from the driving portion 305 through the power conversion member 7 may give rise to the following problem remarkably. The connection state between the developer supply opening 5*b* of the bottle shutter 5 shown in FIG. 13 and the developer receiving port 302*a* of the developer reception member 302 shown in part (a) of FIG. 3 is unstable. Such a phenomenon is particularly remarkable when the driving portion 305 shown in FIG. 3 intermittently transmits the driving force to the drive receiving portion 7*a* shown in FIG. 7.

With the developer supply container 1 of this embodiment, the developer is discharged using the suction and discharging of the air in accordance with the expanding-and-contracting operation of the expansion-and-contraction member 9 in the form of the bellow-like pump shown in FIG. 17. Therefore, the resistance of the air produces of force of spacing instantaneously between the developer supply opening 5*b* of the bottle shutter 5 shown in FIG. 13 and the developer receiving port 302*a* of the developer reception member 302 shown in part (a) of FIG. 3.

However, in this embodiment, the holding projection 4*h* of the holding member 4 as the holding portion shown in FIG. 11 is pressed downwardly in part (b) of FIG. 3. That is, the holding projection 4*h* is pressed downwardly in part (b) of FIG. 3 by the contact side 304*a*4 of the suppressing portion 304*a*2 of the pulling member 304*a* of the holding mechanism 304 shown in FIG. 3 as a result of rotation by the urging force of the urging member 304*b*.

In addition, the drive receiving portion 7*a* shown in FIG. 7 is pressed downwardly in part (b) of FIG. 3 by the reaction force of the driving force transmitted from the driving portion 305 at the upper position in FIG. 3.

With respect to the direction of the arrow d of FIG. 7, the following can be said. Between the holding projection 4*h* of the holding member 4 shown in FIG. 11 and the drive receiving portion 7*a* shown in FIG. 7, the developer supply opening 5*b* of the bottle shutter 5 shown in FIG. 13 and the developer receiving port 302*a* of the developer reception member 302 shown in part (a) of FIG. 3 are in fluid communication with each other.

That is, the developer supply container 1 in the mounted position is as follows. The holding projection 4*h* of the holding member 4 as the holding portion shown in FIG. 11 is urged in the mounting direction of the developer supply container 1 by the contact side 304*a*4 of the suppressing portion 304*a*2 of the pulling member 304*a* of the holding mechanism 304 shown in FIG. 3 which is rotatable by the urging force of the urging member 304*b*.

Further, it also receive the urging force in the connecting direction between the developer receiving port 302*a* of the developer reception member 302 shown in part (a) of FIG. 3 and the developer supply opening 5*b* of the bottle shutter 5 shown in FIG. 13 as the discharge opening for discharging the developer from the developer accommodating portion 2a.

By this, the developer supply opening 5b of the bottle shutter 5 shown in FIG. 13 and the developer receiving port 302a of the developer reception member 302 shown in part (a) of FIG. 3 does not displace in the downward direction or in the upper world direction in part (b) of FIG. 3.

That is, it is possible to maintain the connection state between the developer supply opening 5b of the bottle shutter 5 shown in FIG. 13 and the developer receiving port 302a of the developer reception member 302 shown in part (a) of FIG. 3 in the state that the mounting of the developer supply container 1 is completed.

Therefore, the scattering of the developer in the connecting portion between the developer supply opening 5b of the bottle shutter 5 shown in FIG. 13 and the developer receiving port 302a of the developer reception member 302 shown in part (a) of FIG. 3 can be reduced.

Comparison Example 1

If the holding projection 4h is provided between the developer supply opening 5b and the drive receiving portion 7a as comparison example 1 the position does not deviate in the mounting direction similarly to the developer supply container 1 of the embodiment in the mounting operation of the developer supply container 1.

However, in the developer supplying operation of the developer supply container 1, the developer supply opening 5b is at a position remoter from the drive receiving portion 7a than the holding projection 4h. For this reason, it is difficult to regulate the instantaneous displacement of the developer supply opening 5b by the reaction force received by the drive receiving portion 7a from the driving portion 305 and/or the air resistance resulting from the discharging of the developer using the expanding-and-contracting operation of the expansion-and-contraction member 9. In this case, the connection state between the developer supply opening 5b and the developer receiving port 302a is deteriorated.

In addition, the distance between the drive receiving portion 7a and the holding projection 4h is necessarily smaller than in the case of the developer supply container 1 of the embodiment. For this reason, the constraining effect to the developer supply container 1 by the pulling member 304a is poorer if the similar urging member 304b is used.

Therefore, as compared with the developer supply container 1 of this embodiment, the stable supplied of the developer is deteriorated, and in addition, the amount of the scattered developer from the connecting portion between the developer supply opening 5b and the developer receiving port 302a increases.

Particularly, the developer supply container 1 of this embodiment uses the airflow produced by the expanding-and-contracting operation of the expansion-and-contraction member 9 to supplies the developer out. Therefore, even if the gap produced by the deterioration of the connection state between the developer supply opening 5b and the developer receiving port 302a is small, the leakage of the developer easily occurs, because the developer is blown out together with the air.

In order to solve the problem with the comparison example 1, it would be considered that the urging force of the urging member 304b of the holding mechanism 304 is increased to confine the developer supply container 1 by a stronger force. In such a case, the sliding resistance force upon the mounting operation of the developer supply container 1 increases with the result of deterioration of the mounting operation property of the developer supply container 1.

In addition, the spacing distance between the holding projection 4h of the holding member 4 shown in FIG. 11 and the contact portion 6a of the protecting member 6 shown in FIG. 14 is longer than in the case of the developer supply container 1 of this embodiment. This leads to the longer distance between the abutting portion 304a1 of the holding mechanism 304 of the developer receiving device 300 shown in FIG. 6 and the suppressing portion 304a2. This results in upsizing of the pulling member 304a necessarily.

More particularly, a large space is required by the developer receiving device 300 with the result of upsizing of the main assembly of the image forming apparatus 100. Therefore, the positional deviation of the developer supply container 1 during the developer supplying operation is regulated as in the developer supply container 1 of this embodiment.

For this purpose, the spacing distance, which is a main cause of the positional deviation, between the drive receiving portion 7a shown in FIG. 7 for receiving the driving force from the driving portion 305 shown in FIG. 3 and the holding projection 4h of the holding member 4 shown in FIG. 11 for limiting the positional deviation of the developer supply container 1 is made large as much as possible.

Further, the spacing distance between the suppressing portion 304a2 of the pulling member 304a of the holding mechanism 304 of the developer supply container 1 shown in FIG. 6 and the holding projection 4h of the holding member 4 shown in FIG. 11 engaged with the suppressing portion 304a2 is reduced as much as possible.

Furthermore, it is preferable that the developer supply opening 5b of the bottle shutter 5 shown in FIG. 13 is provided between the drive receiving portion 7a shown in FIG. 7 and the holding projection 4h of the holding member 4 shown in FIG. 11. The developer supply opening 5b of the bottle shutter 5 is effective to assure the connection state with the developer receiving port 302a of the developer reception member 302 shown in FIG. 3.

Comparison Example 2

Comparison example 2 will be considered in which the developer supply container 1 and the developer receiving device 300 are not provided with the holding projection 4h and the holding mechanism 304. At the time when the mounting of the developer supply container 1 of comparison example 2 is completed by the user, no positional deviation is produced between the developer receiving port 302a and the developer supply opening 5b.

However, if the user stops the developer supply container 1 halfway of the mounting, for example, the developer supply container 1 is not pulled in to the mounting completion position, because the holding mechanism 304 shown in FIG. 6 is not provided. Therefore, the developer supply opening 5b and the developer receiving port 302a are not brought into fluid communication with each other, and it is difficult to stably supply the developer out of the developer supply container 1.

In addition, even if the developer supply container 1 can be mounted, the following problem arises because of the reaction force of the driving force received by the drive receiving portion 7a from the driving portion 305 in the supplying operation of the developer supply container 1 and because of the resistance of the air discharging the discharging. The developer supply opening 5*b* and the developer receiving port 302*a* tend instantaneously to displace away from each other.

Therefore, the developer cannot be stably supplied out of the developer supply container 1, and in addition, the amount of the scattered developer from the connecting portion between the developer supply opening 5*b* and the developer receiving port 302*a* is large.

FIG. 18 shows the results of property comparison between the developer supply container 1 of this embodiment and the developer supply containers of comparison examples 1 and 2.

In FIG. 18, the mounting stability means a certainty of the mounting operation of the developer supply container 1, and the supply stability means the supply property stability of the developer from the developer supply opening 5*b* of the bottle shutter 5 shown in FIG. 13. The developer contamination is the contamination of the developer supply container 1 and the developer receiving device 300 by the scattering of the developer. The compactness means whether the space saving of the developer receiving device 300 or the image forming apparatus 100 is possible or not. In FIG. 18, "O" means superiority over the other structures, and "X" means inferiority to the other structures.

As shown in FIG. 18, the developer supply container 1 of this embodiment is advantageous over the developer supply containers of comparison examples 1 and 2 in the mounting stability, which leads to the stabilized developer supply property. Further, the contamination by the developer can be reduced. Furthermore, the downsizing of the image forming apparatus 100 and the developer receiving device 300 can be accomplished.

According to the developer supply container 1 provided by the embodiment, the developer supply container 1 can be assuredly mounted to the developer receiving device 300 in the mounting operation thereof. In addition, in the developer supplying operation, the developer supply container 1 can be retained assuredly at the mounted position of the developer receiving device 300. Further, the stabilized developer supply property can be accomplished. Furthermore, the scattering of the developer from the connecting portion between the developer supply container 1 and the developer receiving device 300 can be prevented, and the contamination of the developer supply container 1 and the developer receiving device 300 attributable to the developer leakage can be prevented.

INDUSTRIAL APPLICABILITY

According to the present invention, the stability of the connection between the discharge opening of the developer supply container and the receiving port of the image forming apparatus side can be improved.

The invention claimed is:

1. A developer supplying system comprising:

a developer replenishing apparatus; and a developer supply container detachably mountable to the developer replenishing apparatus, wherein the developer replenishing apparatus includes:

a mounting device configured and positioned to demountably mount the developer supply container;

a developer receiver configured and positioned to receive developer from the developer supply container;

a driver configured and positioned to apply a driving force to the developer supply container; and a single toggle configured and positioned to attract the developer supply container toward a mounting position when the developer supply container is being mounted to the developer replenishing apparatus, wherein the developer supply container includes:

a developer discharging body;

a developer accommodating body configured and positioned to accommodate the developer;

a discharge opening, provided on the developer discharging body, configured and positioned to discharge the developer accommodated in the developer accommodating body from the developer discharging body;

a feeding portion, provided on the developer accommodating body, configured and positioned to feed the developer in the developer accommodating body toward the developer discharging body;

a gear configured and positioned to receive a rotational force from the driver for rotating the feeding portion; and a projection to be toggled at each of lateral sides of the developer discharging body, the each projection to be toggled being projected in a direction perpendicular to a rotational axis of the feeding portion, wherein the discharge opening is disposed between the gear and the projection to be toggled with respect to the rotational axis of the feeding portion and wherein the toggle is rotatable about a horizontal axis that is perpendicular to the rotational axis of the feeding portion to attract both projections to be toggled into the mounting position, with a mounting operation of the developer supply container.

2. A developer supplying system according to claim 1, wherein the developer supply container further comprises a pump positioned and configured to force the developer out of the developer supply container through the discharge opening.

3. A developer supplying system according to claim 1, wherein the rotational axis is below the discharge opening in a vertical direction when the developer container is mounted in the developer replenishing apparatus.

* * * * *